US009017146B2

(12) United States Patent
Nakamura et al.

(10) Patent No.: US 9,017,146 B2
(45) Date of Patent: Apr. 28, 2015

(54) WAFER POLISHING APPARATUS

(71) Applicants: Fujikoshi Machinery Corp., Nagano-shi, Nagano (JP); National Institute of Advanced Industrial Science and Technology, Tokyo (JP)

(72) Inventors: Yoshio Nakamura, Nagano (JP); Yoshio Otsuka, Nagano (JP); Takashi Okubo, Nagano (JP); Kazutaka Shibuya, Nagano (JP); Takayuki Fuse, Nagano (JP); Shiro Hara, Tsukuba (JP); Sommawan Khumpuang, Tsukuba (JP); Shinichi Ikeda, Tsukuba (JP)

(73) Assignees: Fujikoshi Machinery Corp., Nagano (JP); National Institute of Advanced Industrial Science and Technology, Tokyo (JP)

( * ) Notice: Subject to any disclaimer, the term of this patent is extended or adjusted under 35 U.S.C. 154(b) by 0 days.

(21) Appl. No.: 14/096,226

(22) Filed: Dec. 4, 2013

(65) Prior Publication Data

US 2014/0154958 A1 Jun. 5, 2014

(30) Foreign Application Priority Data

Dec. 4, 2012 (JP) ..... 2012-265731

(51) Int. Cl.

| | |
|---|---|
| ***B24B 37/34*** | (2012.01) |
| ***B24B 7/22*** | (2006.01) |
| ***B24B 37/16*** | (2012.01) |
| ***B24B 53/017*** | (2012.01) |

(Continued)

(52) U.S. Cl.

CPC ..... *B24B 7/228* (2013.01); *B24B 37/16* (2013.01); *B24B 53/017* (2013.01); *B24B 37/105* (2013.01); *B24B 37/26* (2013.01); *B24B 37/30* (2013.01); *B24B 37/345* (2013.01)

(58) Field of Classification Search

CPC .... B24B 37/345; B24B 37/04; B24B 41/005; B24B 57/02; B24B 53/017; B24B 53/007; B24B 53/12; B24B 53/00; B24B 53/10

USPC ..... 451/41, 57, 58, 67, 72, 285–290, 444

See application file for complete search history.

(56) References Cited

U.S. PATENT DOCUMENTS 4,481,741 A * 11/1984 Bouladon et al. ..... 451/285
5,503,592 A * 4/1996 Neumann ..... 451/278

(Continued)

FOREIGN PATENT DOCUMENTS

JP 6-198561 A 7/1994
JP 9-029617 A 2/1997

(Continued)

*Primary Examiner* — George Nguyen
(74) *Attorney, Agent, or Firm* — Birch, Stewart, Kolasch & Birch, LLP

(57) ABSTRACT

The wafer polishing apparatus comprises a polishing plate, a polishing head capable of holding a wafer, and a slurry supplying section. The polishing plate includes: a plurality of concentric polishing zones, each of which has a prescribed width for polishing the wafer and on each of which a polishing cloth is adhered; and a groove for discharging slurry being formed between the polishing zones. A head cleaning section, which cleans the polishing head, or a wafer cleaning section, which cleans the polished wafer, is provided to a center part of the polishing plate and located on the inner side of the innermost polishing zone.

29 Claims, 13 Drawing Sheets

(51) Int. Cl.

| | |
|---|---|
| ***B24B 37/10*** | (2012.01) |
| ***B24B 37/26*** | (2012.01) |
| ***B24B 37/30*** | (2012.01) |

(56) References Cited

U.S. PATENT DOCUMENTS

| | | | | | |
|---|---|---|---|---|---|
| 5,972,162 | A | * | 10/1999 | Cesna | 156/345.13 |
| 5,975,991 | A | * | 11/1999 | Karlsrud | 451/41 |
| 6,116,991 | A | * | 9/2000 | Liu et al. | 451/285 |
| 6,152,806 | A | * | 11/2000 | Nystrom | 451/36 |
| 6,163,954 | A | * | 12/2000 | Nakagawa | 29/603.12 |
| 6,379,230 | B1 | * | 4/2002 | Hayashi et al. | 451/292 |
| 6,869,337 | B2 | * | 3/2005 | Boyd et al. | 451/41 |
| 7,004,823 | B2 | * | 2/2006 | Kisboll et al. | 451/57 |
| 7,261,621 | B2 | * | 8/2007 | Moon et al. | 451/287 |
| 7,455,575 | B2 | * | 11/2008 | Kim et al. | 451/444 |
| 8,047,899 | B2 | * | 11/2011 | Chen et al. | 451/41 |
| 8,870,626 | B2 | * | 10/2014 | Wang | 451/59 |
| 2003/0148712 | A1 | * | 8/2003 | Lim et al. | 451/41 |
| 2009/0047871 | A1 | * | 2/2009 | Muldowney | 451/37 |

FOREIGN PATENT DOCUMENTS

| | | | |
|---|---|---|---|
| JP | 9-277159 | A | 10/1997 |
| JP | 10-340870 | A | 12/1998 |
| JP | 2001-053051 | A | 2/2001 |
| JP | 2003-305638 | A | 10/2003 |

* cited by examiner

WAFER POLISHING APPARATUS

CROSS-REFERENCE TO RELATED APPLICATION

This application is based upon and claims the benefit of priority of the prior Japanese Patent Application No. P2012-265731, filed on Dec. 4, 2012, and the entire contents of which are incorporated herein by reference.

FIELD

The present invention relates to a wafer polishing apparatus.

BACKGROUND

In a conventional semiconductor wafer polishing apparatus, a wafer to be polished is held by a wafer holding plate (a carrier) of a polishing head, a surface of the wafer is brought into contact with a polishing cloth adhered on an upper face of a polishing plate, and the polishing plate and the polishing head are relatively moved with respect to each other, with supplying slurry onto the polishing cloth, so that the surface of the wafer can be polished.

In a wafer polishing apparatus disclosed in Japanese Laid-open Patent Publication No. 10-340870, dedicated polishing plates and mechanisms for different polishing processes, e.g., a polishing plate for primary polishing, a polishing plate for secondary polishing, a polishing plate for finish polishing, a wafer cleaning mechanism, are provided.

In a wafer polishing apparatus disclosed in Japanese Laid-open Patent Publication No. 9-277159 or No. 2003-305638, different polishing cloths are concentrically adhered on an inner part and an outer part of a polishing face of a polishing plate so as to continuously perform different polishing processes.

In the wafer polishing apparatus disclosed in Japanese Laid-open Patent Publication No. 10-340870, the dedicated polishing plates and mechanisms for different polishing processes are provided, so the wafer polishing apparatus must be large in size.

In the wafer polishing apparatus disclosed in Japanese Laid-open Patent Publication No. 9-277159, the different polishing cloths are concentrically adhered on one polishing plate, so different types of slurries which are used in different polishing processes will be mixed on the polishing plate. Further, in some cases, break-in times, life spans, etc. of the polishing cloths for the different processes, e.g., the primary polishing process, the finish polishing process, are extremely-different. If the polishing cloths whose characteristics are extremely-different are simultaneously used, the inner polishing cloth and the outer polishing cloth are separately exchanged. But, it is very difficult to separately exchange the polishing cloths.

In the wafer polishing apparatus disclosed in Japanese Laid-open Patent Publication No. 2003-305638, a groove is formed between polishing zones, so that mixing slurries can be prevented. However, a plurality of polishing heads, each of which corresponds to each of the polishing zones, are provided, so a structure of the wafer polishing apparatus must be complicated, and a size thereof must be large.

SUMMARY

Accordingly, it is an object to provide a wafer polishing apparatus capable of solving the above described problems of the conventional wafer polishing apparatuses. In the wafer polishing apparatus of the present invention, a plurality of concentric polishing zones are formed on a polishing plate and a head cleaning section or a wafer cleaning section is provided to a center part of the polishing plate, so that the wafer polishing apparatus can be downsized.

To achieve the objects, the present invention has following structures.

Namely, the wafer polishing apparatus of the present invention comprises: a polishing plate having an upper face, on which a polishing cloth is adhered; a polishing head having an lower face for holding a wafer; and a slurry supplying section for supplying slurry to the upper face of the polishing plate, the wafer held by the polishing head is pressed onto the polishing cloth, the polishing plate and the polishing head are relatively moved with respect to each other, with supplying slurry, so as to polish the wafer, the polishing plate includes:

a plurality of concentric polishing zones, each of which has a prescribed width for polishing the wafer and on each of which a polishing cloth is adhered; and a groove for discharging slurry being formed between the polishing zones, and a head cleaning section, which cleans the polishing head, or a wafer cleaning section, which cleans the polished wafer, is provided to a center part of the polishing plate and located on the inner side of the innermost polishing zone.

By providing one of the cleaning sections at the center part of the polishing plate, space efficiency of the wafer polishing apparatus can be improved and the apparatus can be downsized.

Preferably, the polishing zones are detachably attached to a plate holding section, to which the polishing plate is attached. With this structure, the polishing zones can be easily exchanged.

Further, the polishing zones may be capable of being separately detached from the plate holding section. With this structure, each of the polishing zones can be more easily exchanged.

In the wafer polishing apparatus, the polishing zones may be detachably positioned, on the plate holding section, by positioning pins.

In the wafer polishing apparatus, heights of the polishing faces of the polishing zones may be different from each other.

Preferably, the height of the polishing face of the outer polishing zone is higher than that of the inner polishing zone. With this structure, mixing slurries can be prevented.

In the wafer polishing apparatus, the polishing zones may have through-holes, in each of which a height is reduced outward so as to discharge the slurry in the groove to outside of the polishing plate.

In the wafer polishing apparatus, the wafer cleaning section may be provided to the center part of the polishing plate, the head cleaning section may be provided to a periphery of the polishing plate, and the polishing head may convey the wafer to the wafer cleaning section.

Alternatively, the head cleaning section may be provided to the center part of the polishing plate, the wafer cleaning section may be provided to a periphery of the polishing plate, and the polishing head may convey the wafer to the wafer cleaning section.

In the above described wafer polishing apparatus, the wafer cleaning section may comprise:

a cleaning tank, into which the cleaning liquid is introduced, having an upper part, which is a cylindrical section;

a rotor, which is formed into a cylindrical shape, having a lower part, which is fitted with the cylindrical section of the cleaning tank and capable of rotating about an axial line of the cylindrical section, and an upper face, which includes an opening section whose edge acts as a mount section on which the wafer to be cleaned and dried can be mounted;

a drive section for rotating the rotor; and a bearing being formed between the lower part of the rotor and the cylindrical section of the cleaning tank.

Further, the polishing head may comprise:

a main part having a lower face, to which a press section is provided;

a wafer holding plate being held on the lower face of the main part and capable of tilting with respect to the main part, the wafer holding plate having a lower face, on which the wafer to be polished can be held; and an elastic ring being attached to the press section of the main part, the elastic ring pressing an upper face of the wafer holding plate, and the wafer holding plate, which receives an elastic force of the elastic ring, may be capable of tilting along with a surface of the polishing cloth of the polishing plate when the wafer is pressed onto the polishing cloth of the polishing plate, together with the elastic ring and the wafer holding plate, by the press section on the main part.

In the wafer polishing apparatus of the present invention, the plurality of concentric polishing zones are formed on the one polishing plate, and the head cleaning section or the wafer cleaning section is provided at the center part of the polishing plate. Therefore, the wafer polishing apparatus can be downsized.

BRIEF DESCRIPTION OF THE DRAWINGS

Embodiments of the present invention will now be described by way of examples and with reference to the accompanying drawings.

DESCRIPTION OF THE PREFERRED EMBODIMENTS

Preferred embodiments of the present invention will now be described in detail with reference to the accompanying drawings.

Firstly, Minimal (trademark) fab concept will be briefly explained.

To mass-produce semiconductor devices, semiconductor wafers have been grown in size. These days, large wafers whose diameters are 300 mm or more are being used. To improve productivity, the large wafer is, for example, continuously polished, cleaned, dried, chemical-vapor-deposited (CVD), exposed, developed, etched and finally diced. To perform a sequence of these steps, a large scale productive facility, which costs billions of dollars, is required.

However, producing a wide variety of semiconductor devices in small quantities is required for a wide range of application. The above described large scale facility is not adequate to the manner of producing a wide variety products in small quantities.

Thus, these days, said Minimalfab Concept, in which required processes are performed in a small size wafer, whose diameter is, for example, 0.5 inch and from which one semiconductor device is produced, has been proposed. In the Minimalfab Concept, small-sized processing units, e.g., polishing unit, CVD unit, are provided for the required processes. The processing units can be suitably combined according to the required processes, so that a wide variety of semiconductors can be produced in the wafer polishing apparatus. The processing units are small units, so facility investment can be reduced.

The wafer polishing apparatus of the present embodiment can be suitably applied to the Minimalfab Concept. Namely, the wafer polishing apparatus is capable of suitably polishing a small size wafer having a diameter of, for example, about 0.5 inch.

Figure 1:
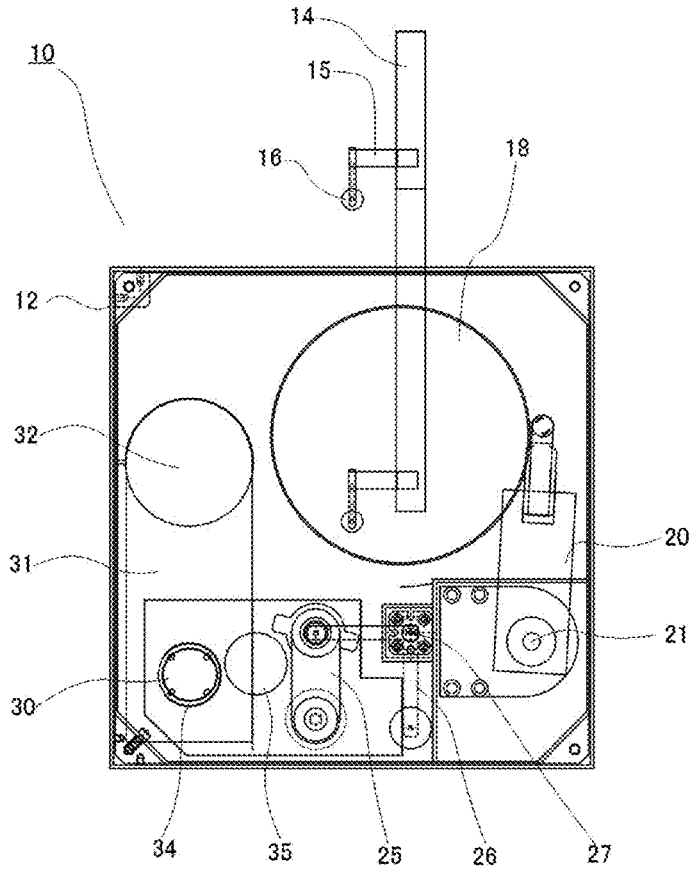
FIG. 1 is a schematic plan view of a wafer polishing apparatus.
Figure 2:
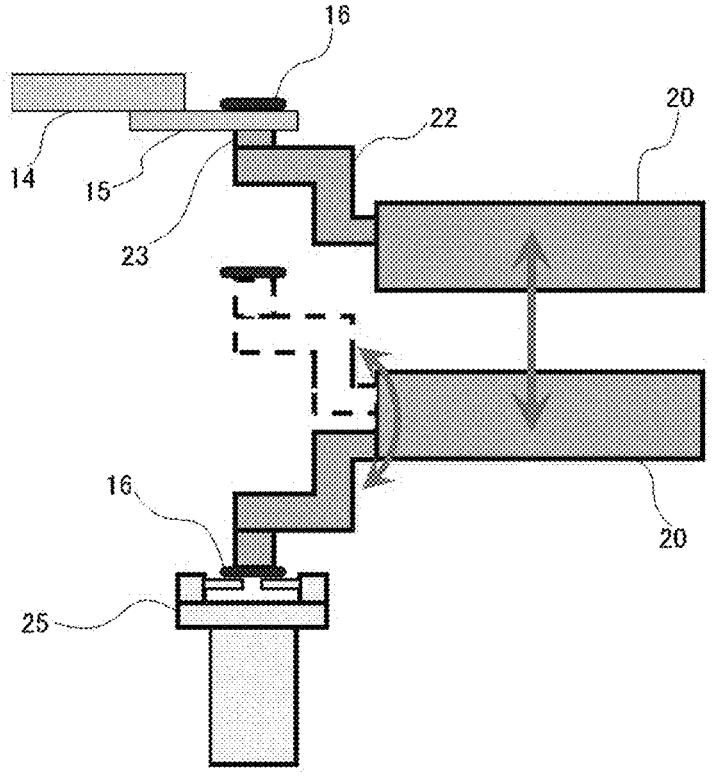
FIG. 2 is an explanation view showing an action of a transfer arm.
Figure 3:
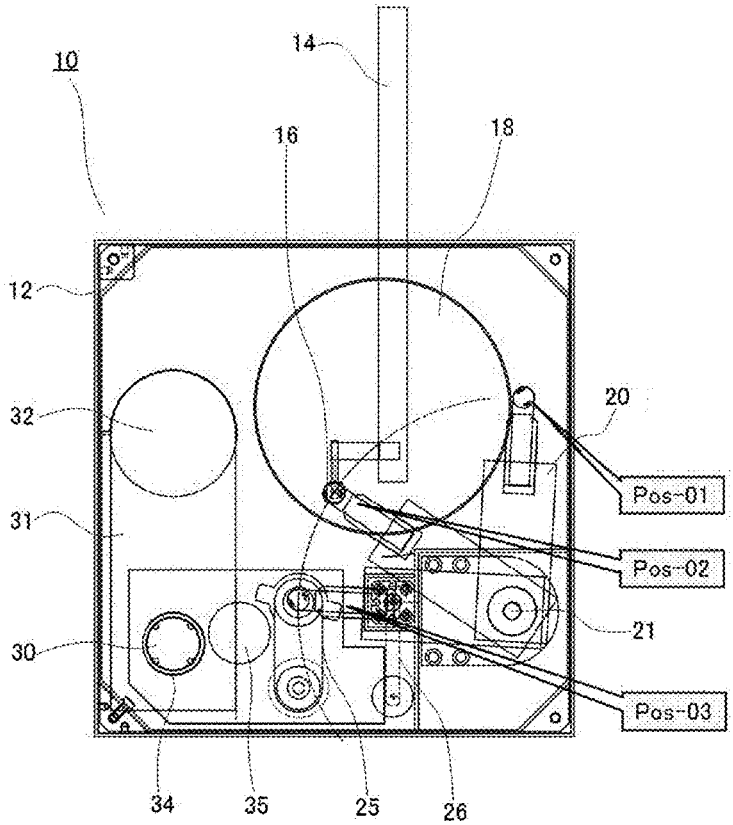
FIG. 3 is an explanation view showing rotational positions of the transfer arm.
Figure 4:
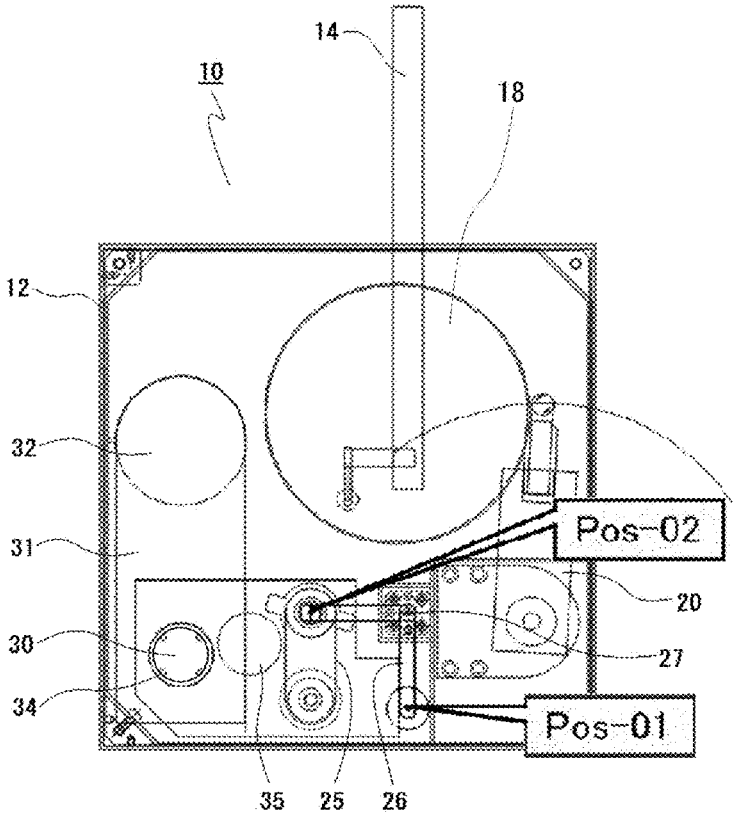
FIG. 4 is an explanation view showing rotational positions of a stopper.
Figure 5:
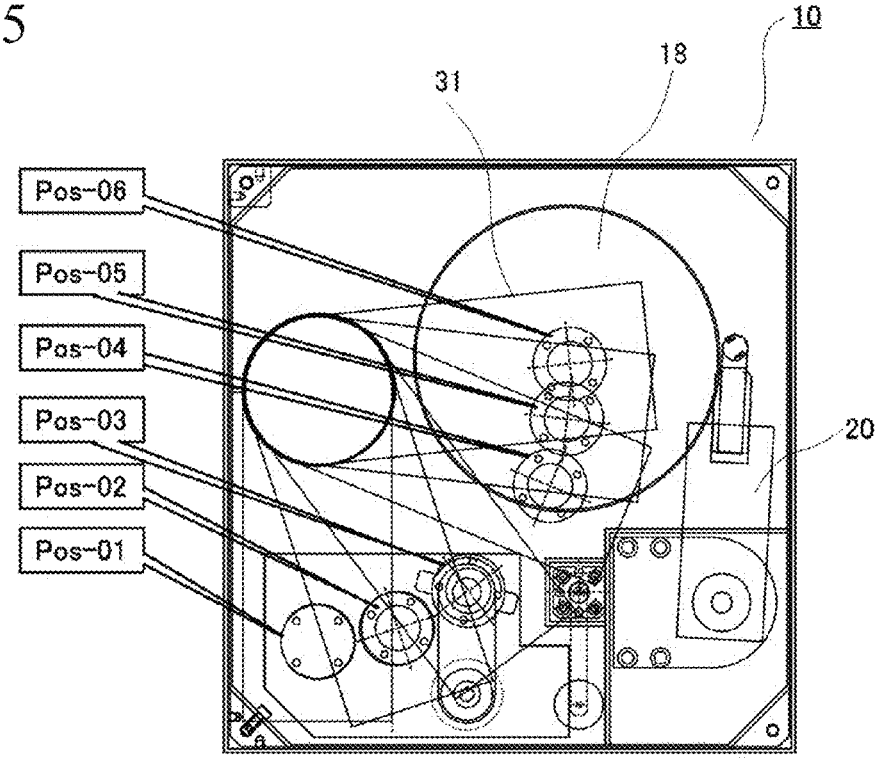
FIG. 5 is an explanation view showing rotational positions of an arm unit.

FIG. 1 is a schematic plan view of the wafer polishing apparatus; FIG. 2 is an explanation view showing an action of a transfer arm; FIG. 3 is an explanation view showing rotational positions of the transfer arm; FIG. 4 is an explanation view showing rotational positions of a stopper; and FIG. 5 is an explanation view showing rotational positions of an arm unit.

Firstly, parts of the wafer polishing apparatus 10 of the present embodiment will be schematically explained, and then details will be explained.

Component units of the wafer polishing apparatus 10 are provided in a process chamber 12. In the Minimalfab Concept, the size of the process chamber 12 is standardized, e.g., 30 cm square. Therefore, the component units of the wafer polishing apparatus 10 are downsized, as much as possible, so as to accommodate them in the process chamber 12 having such size.

In FIG. 1, a conveying arm 14 has a mount section 15 which is formed into, for example, a U-shape, a wafer 16 to be polished is spanned on the mount section 15 in a state where the surface to be polished is faced upward, and the conveying arm 14 conveys the wafer 16 into a center part of the process chamber 12 from outside. Note that, the conveying arm 14 further conveys the processed wafer 16, which has been polished, cleaned and dried, to outside of the process chamber 12. The conveying arm 14 is driven by a suitable driving mechanism (not shown), e.g., rack-pinion mechanism, cylinder mechanism. The driving mechanism is not limited.

A polishing plate 18, which can be rotated in a horizontal plane, is provided in the process chamber 12, which is located under the conveying arm 14. As described below, the polishing plate 18 includes a plurality of concentric polishing zones, on each of which a polishing cloth is adhered and each of which has a prescribed width for polishing the wafer. A groove for discharging slurry is formed between the polishing zones. A head cleaning section or a wafer cleaning section is provided to a center part of the polishing plate and located on the inner side of the innermost polishing zone.

A transfer arm 20 for transferring the wafer 16 is located beside the polishing plate 18. The transfer arm 20 is turned, about a shaft 21, between a position Pos01 to a position Pos03 shown in FIG. 3, in a horizontal plane. Note that, the position Pos01 is a standby position. The transfer arm 20 can be moved upward and downward along the shaft 21. An invertible arm 22, which is capable of turning up and down, is provided to a front end of the transfer arm 20. A wafer sucking section 23 is provided to a front end of the invertible arm 22. The wafer sucking section 23 sucks and holds the wafer 16, takes the wafer 16 from the mount section 15 and transfers the wafer 16 to the mount section 15. Each of the sections of the transfer arm 20 is driven by suitable means (not shown), e.g., motors.

A wafer cleaning and drying unit 25, which cleans and dries the wafer 16 and which further acts as a mount port on which the wafer 16 can be mounted, is provided beside the polishing plate 18. The transfer arm 20 sucks and holds the wafer 16 to take the wafer 16 from the mount section 15 (at the position Pos02), inverts the wafer 16 to convey the same into the wafer cleaning and drying unit 25 (at the position Pos03), and transfers the wafer 16, which has been cleaned and dried, from the wafer cleaning and drying unit 25 to the mount section 15 (at the position Pos02).

A stopper (a press arm) 26 is provided beside the polishing plate 18 and capable of turning, about a shaft 27, between a position Pos01 and a position Pos02 shown in FIG. 4. The stopper 26 is turned to the position Pos02 above the wafer 16, which has been conveyed into the wafer cleaning and drying unit 25, so as to prevent the wafer 16 from being pushed out by a pressure of cleaning water. Details of the wafer cleaning and drying unit 25 will hereinafter be explained.

Further, an arm unit 31 for driving a polishing head 30 is provided beside the polishing plate 18. The polishing head 30 is held by the arm unit 31. The arm unit 31 is capable of turning, about a shaft 32, between a position Pos01 to a position Pos06 shown in FIG. 5.

At the position Pos01, a mount section 34, on which a ring-shaped grind stone (not shown) acting as a dressing member will be mounted, is provided under the polishing head 30. Another mount section 35, on which a brush (not shown) acting as another dressing member will be mounted, is located adjacent to the mount section 34 (see FIGS. 3 and 4).

The polishing head 30 is capable of holding and releasing the wafer 16 and the dressing members. By turning the arm unit 31, the polishing head 30 can be moved between the mount section 34 (the position Pos01), the mount section 35 (the position Pos02), the wafer cleaning and drying unit 25 (the position Pos03), a primary polishing zone of the polishing plate 18 (the position Pos04), a secondary polishing zone thereof (the position Pos05) and a cleaning section (the position Pos06). Therefore, in the present wafer polishing apparatus having multiple functions, a primary polishing step, a secondary polishing step, a dressing step, etc. can be continuously performed.

As described above, the polishing head 30 is provided to the arm unit 31 capable of turning about the shaft 32, and the mount section 34 (the position Pos01), the mount section 35 (the position Pos02), the wafer cleaning and drying unit 25 (the position Pos03), the primary polishing zone of the polishing plate 18 (the position Pos04), the secondary polishing zone thereof (the position Pos05) and the cleaning section (the position Pos06) are located on a circular arc. With this arrangement, a space constitution of the wafer polishing apparatus 10 can be compactible. Alternatively, the arm unit 31 equipped with the polishing head 30 may be moved on a linear line. In this case, the mount section 34 (the position Pos01), the mount section 35 (the position Pos02), the wafer cleaning and drying unit 25 (the position Pos03), the primary polishing zone of the polishing plate 18 (the position Pos04), the secondary polishing zone thereof (the position Pos05) and the cleaning section (the position Pos06) are linearly arranged. In this case too, the space constitution of the wafer polishing apparatus 10 can be compactible.

Details of the polishing head 30 and the arm unit 31 will hereinafter be explained.

Successively, the polishing plate 18 will be explained.

Figure 6:
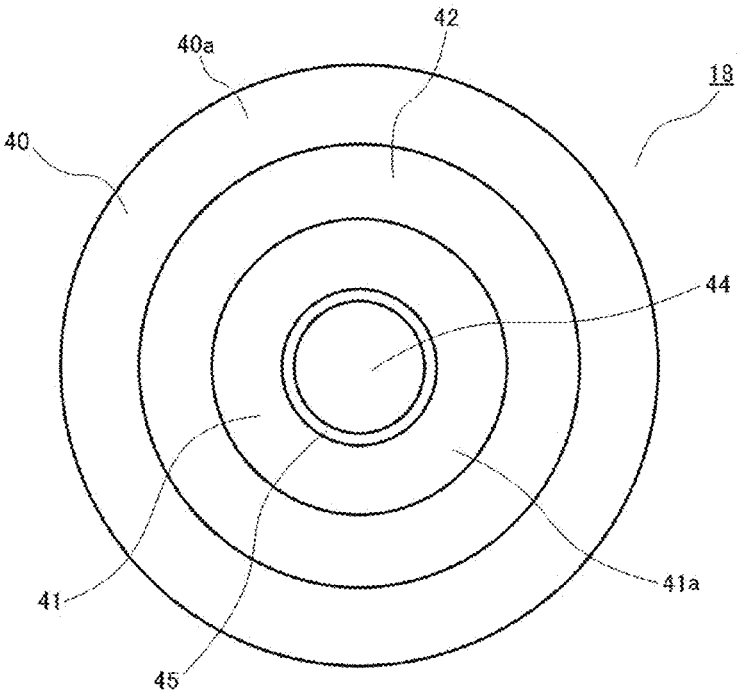
FIG. 6 is a plan view of a polishing plate.
Figure 7:
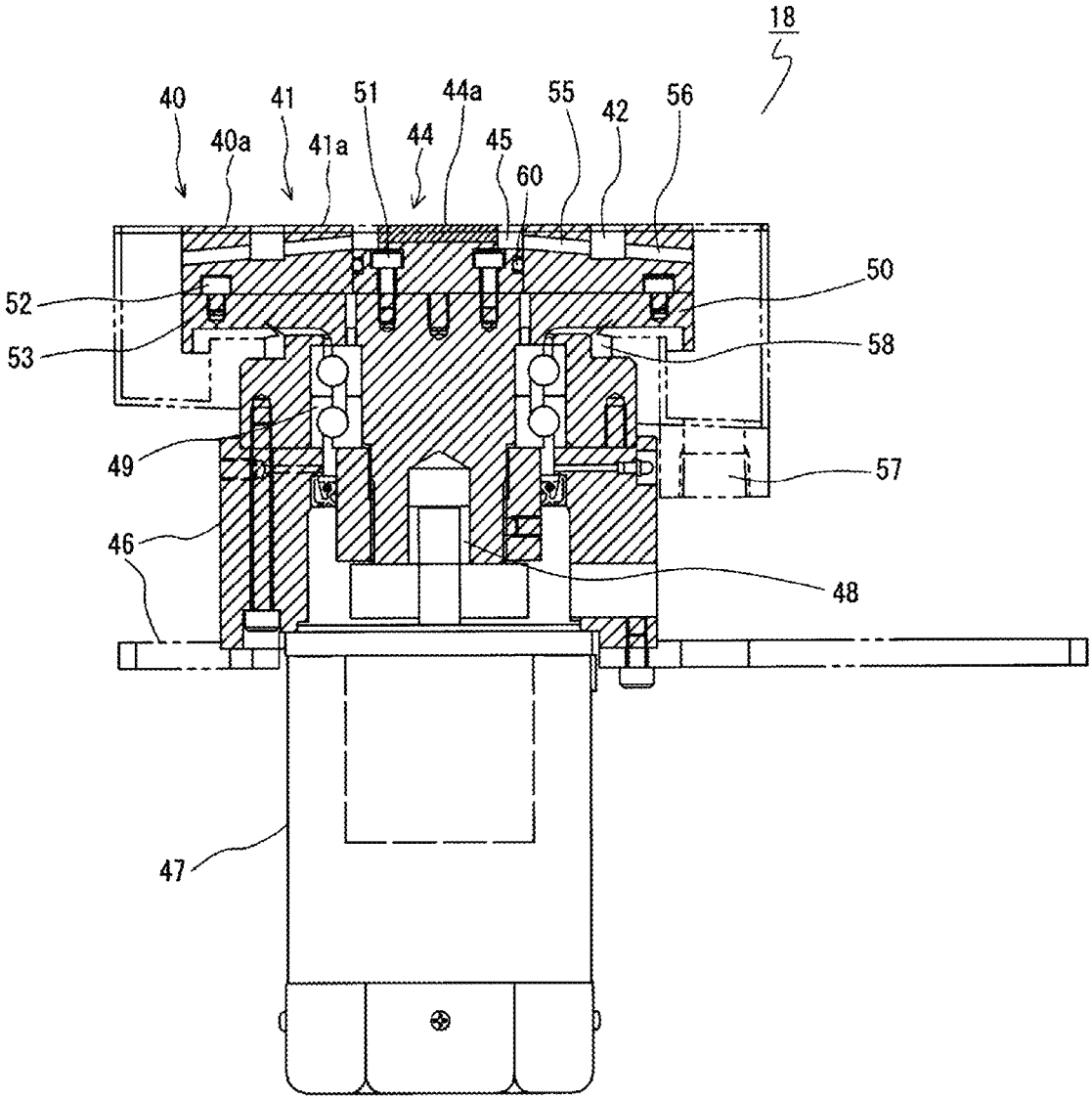
FIG. 7 is a sectional view of the polishing plate.

FIG. 6 is a plan view of the polishing plate 18, and FIG. 7 is a sectional view thereof.

As described above, the polishing plate 18 includes a plurality of concentric polishing parts (e.g., two polishing parts in the present embodiment), which constitute the polishing zones. Polishing cloths 40*a* and 41*a* are respectively adhered on the polishing parts 40 and 41 so as to constitute the primary polishing part (the primary polishing zone) 40 and the secondary polishing part (the secondary polishing zone) 41, which are concentrically arranged and each of which has a prescribed width for polishing the wafer 16. A groove 42 is formed between the primary polishing part 40 and the secondary polishing part 41. The cleaning section 44, which cleans the polishing head 30 or the polished wafer 16, is provided to a center part of the polishing plate 18 and located on the inner side of the innermost secondary polishing zone 41. Further, a groove 45 for discharging slurry is formed between the secondary polishing zone 41 and the cleaning section 44. Note that, in the present embodiment, the cleaning section 44 is a head cleaning section for cleaning the polishing head 30.

The polishing plate 18 is connected to a rotary shaft 48 of a motor 47, which is fixed to a base 46, with a bearing 49. The polishing plate 18 can be rotated in a horizontal plane.

The polishing plate 18 comprises: a plate holding section 50 connected to the rotary shaft 48; and the primary and secondary polishing parts 40 and 41, which are detachably attached to the plate holding section 50. The cleaning section 44 is located on the inner side of the secondary polishing part 41 and fixed to the plate holding section 50 by bolts 51. The primary and secondary polishing parts 40 and 41 are integrated, and pins 52 are downwardly projected from the primary and secondary polishing parts 40 and 41. By fitting the pins 52 into positioning holes 53 formed in an upper face of the plate holding section 50, the primary and secondary polishing parts 40 and 41, can be detachably attached to the plate holding section 50. A torque from the plate holding section 50 side can be transmitted to the primary and secondary polishing parts 40 and 41 by the pins 52.

Through-holes 55, whose height is gradually reduced outward so as to introduce a cleaning liquid and the slurry discharged in the groove 45 to the groove 42, are formed in the secondary polishing part 41. And, through-holes 56, whose height is gradually reduced outward so as to introduce the slurry discharged in the groove 42 to outside of the polishing plate 18, are formed in the primary polishing part 40. The slurry discharged to outside of the polishing plate 18 is discharged to the exterior via a discharge hole 57.

A seal ring 58 seals the bearing 49 so as to prevent invasion of the slurry. Further, an O-ring 60 is provided between an outer circumferential face of the cleaning section 44 and an inner circumferential face of the secondary polishing part 41.

The O-ring 60 prevents the slurry and the cleaning liquid from invading a space between the outer circumferential face of the cleaning section 44 and the inner circumferential face of the secondary polishing part 41. Further, a frictional force between the O-ring 60 and the inner circumferential face of the secondary polishing part 41 by the O-ring 60, so that detachment of the primary and secondary polishing parts 40 and 41 from the plate holding section 50 can be prevented.

A brush 44*a* is attached on an upper face of the cleaning section 44. As described below, a hose for spraying the cleaning liquid is provided to the polishing head 30 side, so that the polishing head 30 can be cleaned by the cleaning liquid, which is sprayed from the hose, and the brush 44*a*.

While performing the polishing actions, different types of slurries are respectively supplied, from slurry supply sections (not shown), onto the polishing cloth 40*a* of the primary polishing part 40 and the polishing cloth 41*a* of the secondary polishing part 41. The slurry for rough polishing is supplied to the primary polishing part 40. The slurry for finish polishing is supplied to the secondary polishing part 41. Types of the both slurries are different, so it is not improper to mix them on the polishing cloths. However, in the present embodiment, most of the slurry on the primary polishing part 40 is discharged to outside of the polishing plate 18 by a centrifugal force of the rotating polishing plate 18, and most of the slurry on the secondary polishing part 41 is discharged to outside of the polishing plate 18 via the groove 42 and the through-holes 56. Therefore, the different types of slurries are not mixed on the polishing cloths.

The cleaning liquid which has been used for cleaning the polishing head 30 is discharged to outside of the polishing plate 18 via the groove 45, the through-holes 55, the groove 42 and the through-holes 56. Further, the slurries and the cleaning liquid discharged to outside of the polishing plate 18 may be respectively collected, by suitable means (not shown). To securely respectively collect them, partitions (not shown), which divide each of the grooves 42 and 45 into an inner circumferential part and an outer circumferential part, may be formed in the grooves 42 and 45. The slurry and the cleaning liquid respectively collected may be reused or stored in tanks.

As described above, the primary and secondary polishing parts 40 and 41 can be easily detached from the plate holding section 50. Therefore, one or both of the polishing cloths 40*a* and 41*a* can be easily exchanged.

Figure 8:
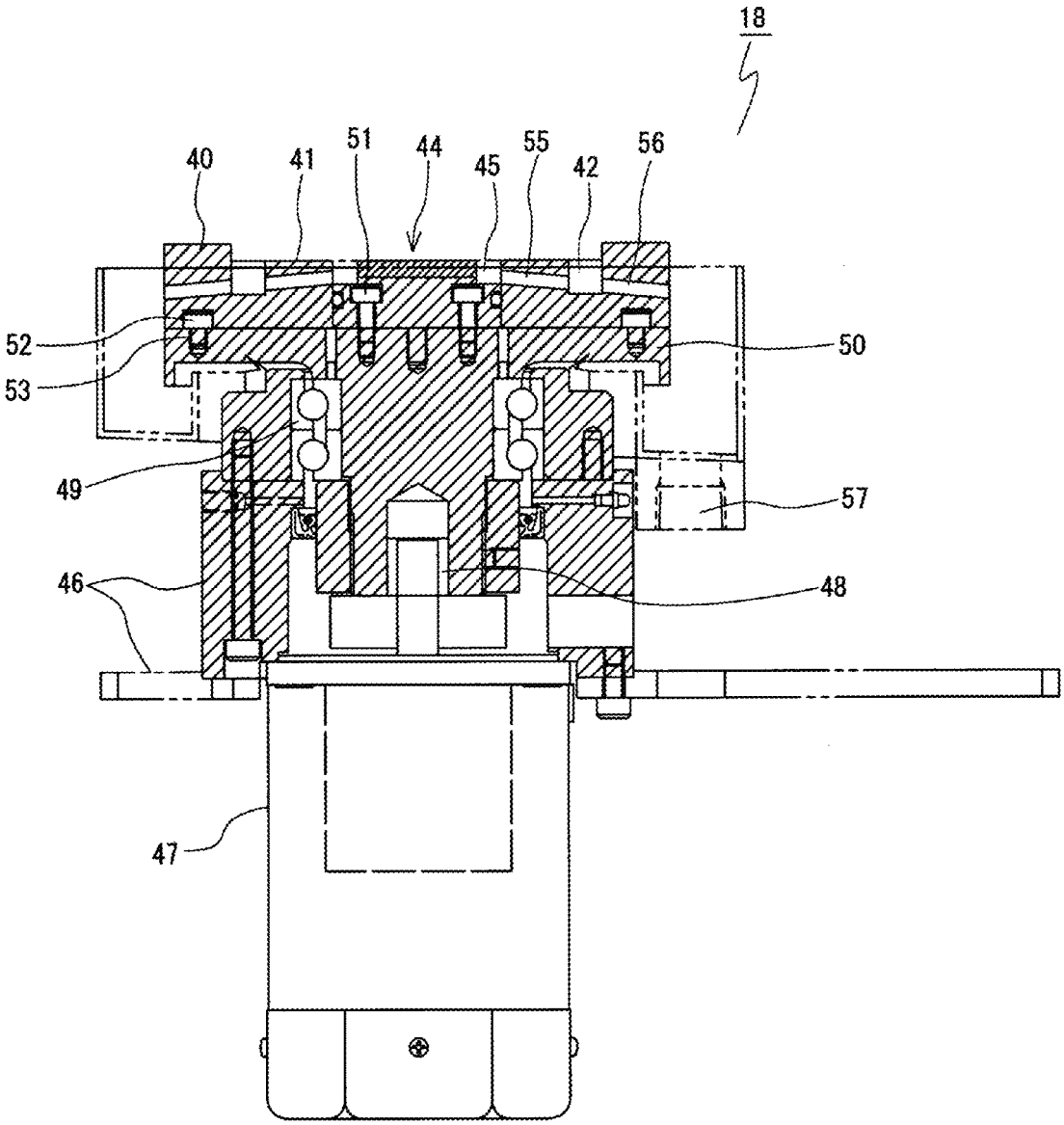
FIG. 8 is a sectional view of another example of the polishing plate.

FIG. 8 is a sectional view of another example of the polishing plate 18.

The structural elements shown in FIG. 7 are assigned the same reference symbols, and explanation will be omitted.

In the polishing plate 18 of the present example, a height of the polishing face of the primary polishing part 40 is higher than that of the secondary polishing part 41. Other structural elements are the same as those of the polishing plate 18 shown in FIG. 7.

The slurries supplied onto the polishing cloths can easily flow outward by the centrifugal force generated by the rotation of the polishing plate 18. Thus, mixing the different types of slurries on the polishing cloths can be effectively prevented by making the outer primary polishing part 40 higher than the inner secondary polishing part 41.

Alternatively, the height of the polishing face of the primary polishing part 40 may be lower than that of the secondary polishing part 41. This structure can be applied to a case where, for example, the slurry for the secondary polishing is allowed to invade into the primary polishing zone 40 but the slurry for the primary polishing is prohibited to invade into the secondary polishing zone 41.

In case of having three or more concentric polishing zones, heights of the polishing faces of the polishing zones may be designed according to use conditions. Namely, height difference between the polishing zones may be designed according to use applications and use conditions.

Figure 9:
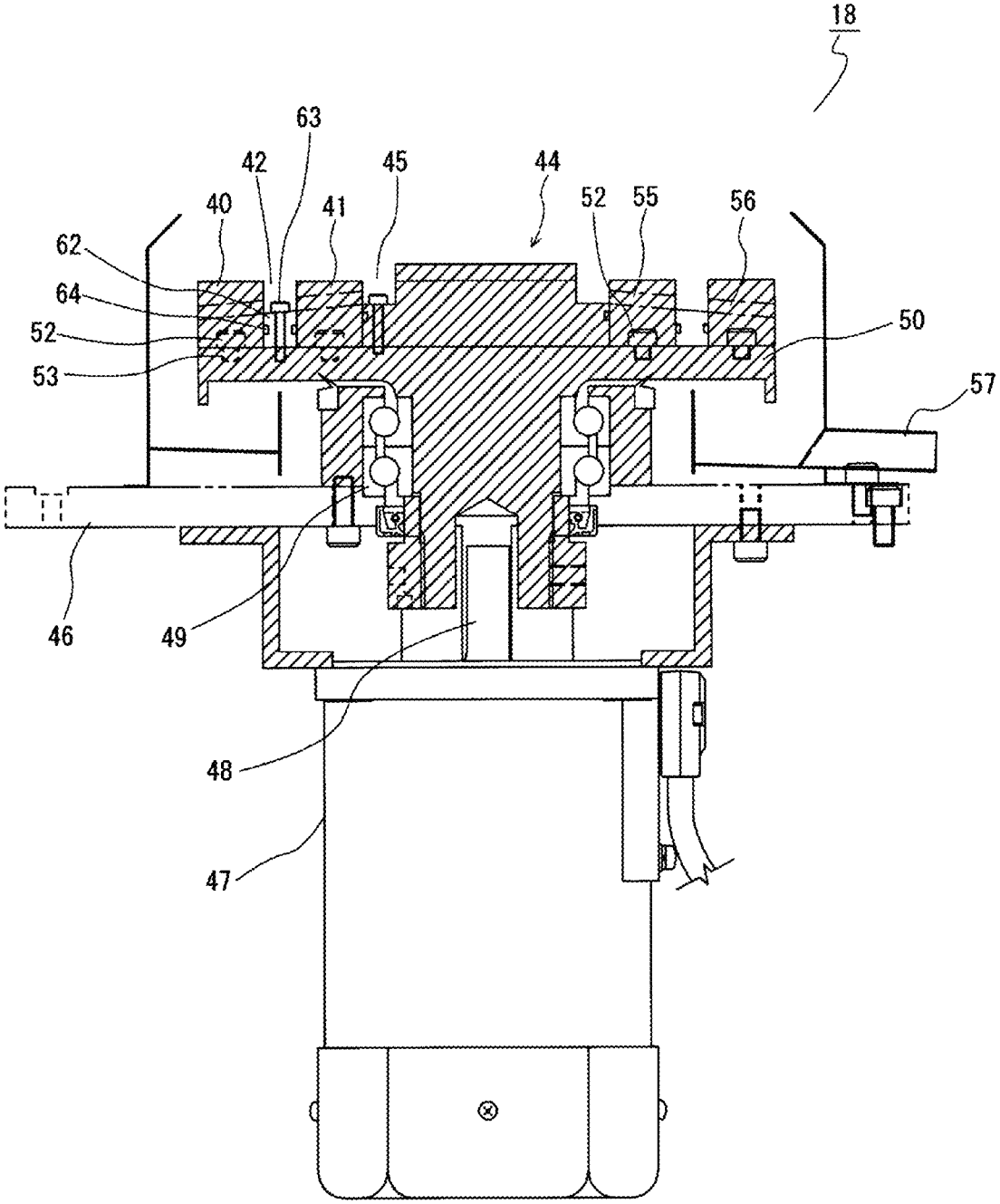
FIG. 9 is a sectional view of a further example of the polishing plate.

FIG. 9 is a sectional view of the polishing plate 18 of a further example.

The structural elements shown in FIGS. 7 and 8 are assigned the same reference symbols, and explanation will be omitted.

In the present example, the primary polishing part 40 is separated from the secondary polishing part 41, and they are attached to the plate holding section 50 with the pins 52 and can be separately detached from the plate holding section 50. Other structural elements are the same as those of the polishing plates 18 shown in FIGS. 7 and 8.

Note that, a ring 62 is fixed in the groove 42 by screws 63, and O-rings 64 are provided between an outer circumferential face of the ring 62 and an inner circumferential face of the primary polishing part 40 and between an inner circumferential face of the ring 62 and an outer circumferential face of the secondary polishing part 41. With this structure, invasion of the slurry can be prevented, and a frictional force can be generated, so that easy detachment of the primary and secondary polishing parts 40 and 41 from the plate holding section 50 can be prevented. Since the primary and secondary polishing parts 40 and 41 can be separately detached from the plate holding section 50, the polishing cloths can be respectively easily exchanged.

Next, details of the wafer cleaning and drying unit 25 will be explained.

Figure 10:
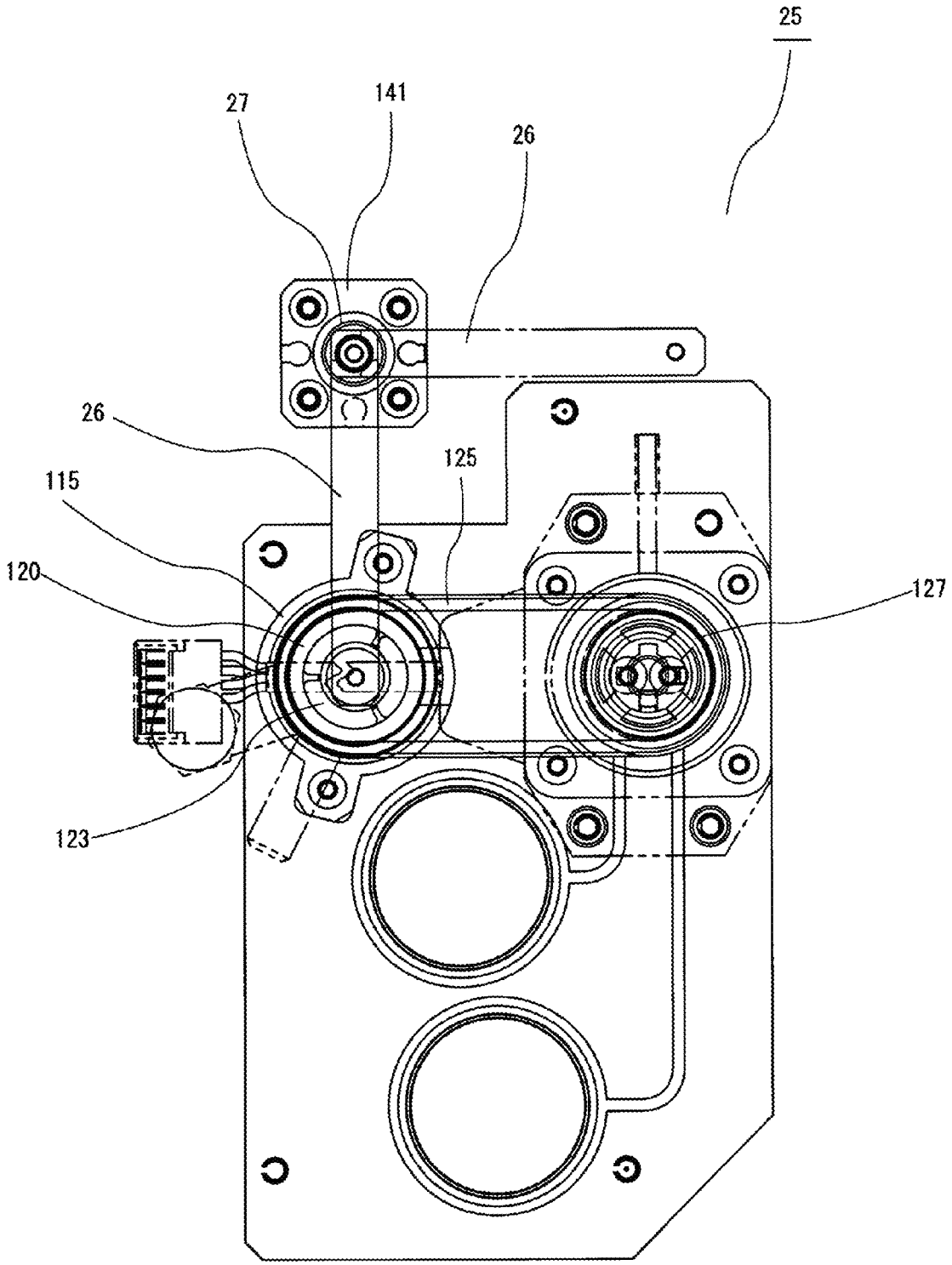
FIG. 10 is a plan view of a wafer cleaning and drying unit.
Figure 11:
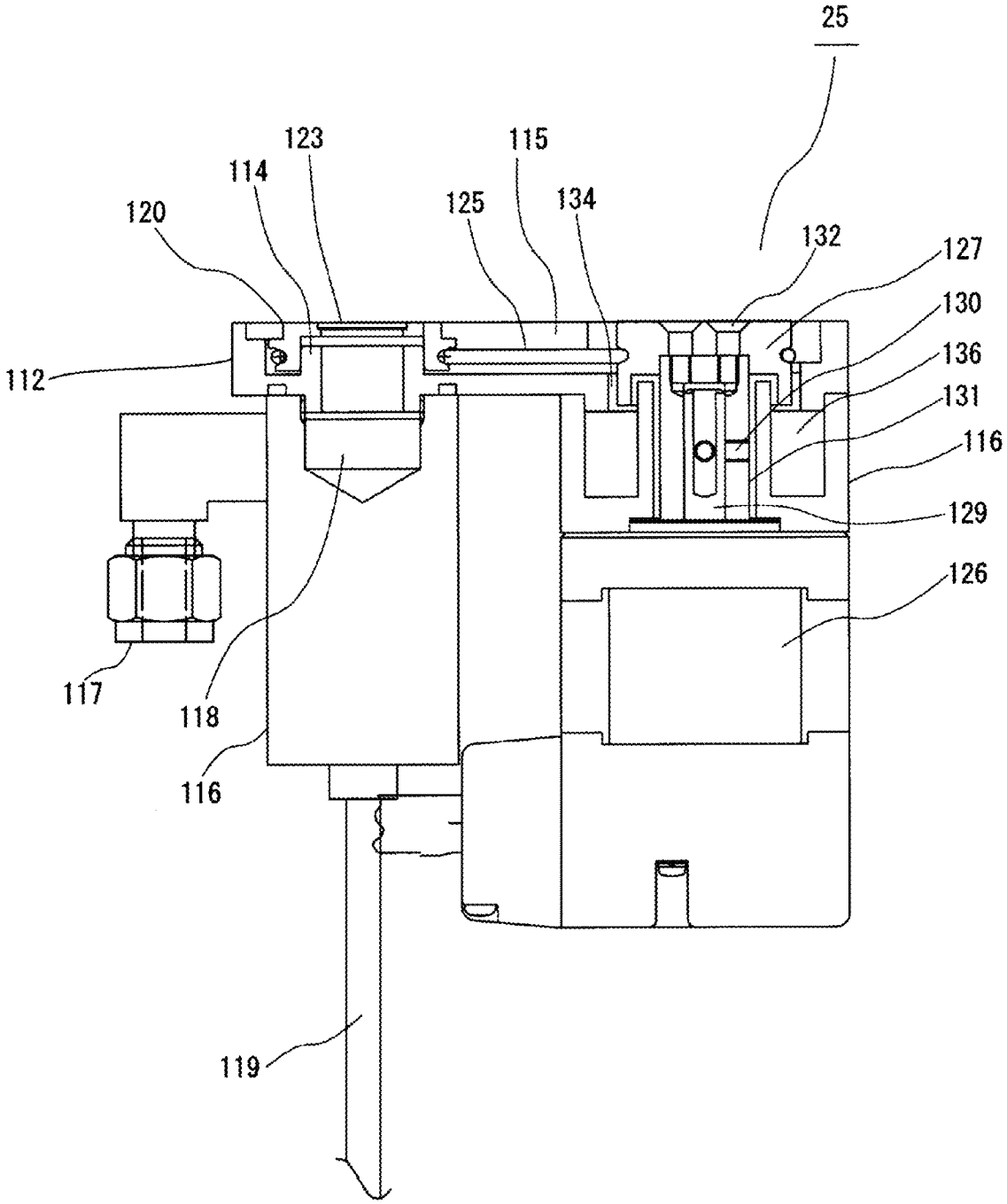
FIG. 11 is a partially cutaway sectional view of the wafer cleaning and drying unit.
Figure 12:
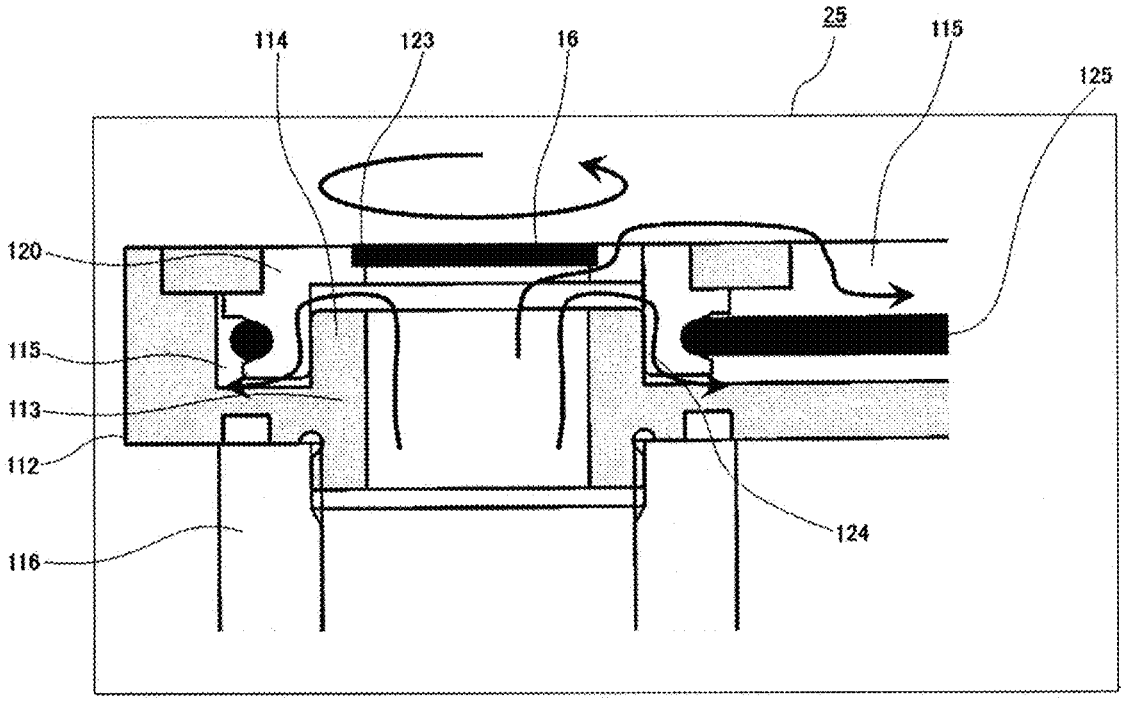
FIG. 12 is an enlarged explanation view of FIG. 11.

FIG. 10 is a plan view of the wafer cleaning and drying unit 25; FIG. 11 is a partially cutaway sectional view thereof; and FIG. 12 is an enlarged explanation view of FIG. 11.

In the drawings, a cleaning tank 112 has a tubular part 113. An upper part of the tubular part 113 is a cylindrical section 114, whose upper face is opened. The cylindrical section 114 is surrounded by a concave section 115. The cleaning tank 112 is fixed on a base 116.

A hose (not shown) is connected to a connection port 117, and the hose is connected to a cleaning liquid tank (not shown). The cleaning liquid, e.g., pure water, is supplied to a lower part of the cleaning tank 112, by a pump (not shown), via the hose, the connection port 117 and flow paths (not shown). An ultrasonic oscillator 118 is provided in the lower part of the cleaning tank 112 so as to apply ultrasonic vibration energy to the cleaning liquid. Namely, the cleaning tank 112 is an ultrasonic cleaning tank. Cables for supplying electric power are accommodated in a pipe 119.

Note that, the ultrasonic oscillator 118 may be omitted. In this case, the wafer may be cleaned by only a stream of the cleaning liquid.

A rotor 120 is formed into a cylindrical shape. A lower part of the rotor 120, which covers the cylindrical section 114 of the cleaning tank, is capable of rotating about an axial line of the cylindrical section 114. The rotor 120 is communicated with the cleaning tank 112. A concave section, whose depth is slightly greater than a thickness of the wafer 16, is formed in an upper face of the rotor 120, and an edge of the opening part acts as a mount section 123, on which the wafer 16 can be mounted.

In the present example, a gap between an inner wall face of the lower part of the rotor 120 and an outer wall face of the cylindrical section 114 of the cleaning tank 112 constitutes a liquid bearing 124. Namely, a space is formed between a lower face of the mount section 123 and an upper face of the cylindrical section 114. A part of the cleaning liquid in the cleaning tank 112 overrides an upper edge of the cylindrical section 114 from said space and flows into a gap between the inner wall face of the lower part of the rotor 120 and the outer wall face of the cylindrical section 114, so that the liquid bearing 124 is formed. The cleaning liquid which has passed through the gap flows into the concave section 115 via a gap between a lower edge of the rotor 120 and an inner bottom face of the concave section 115 (see an arrow shown in FIG. 12).

A circular groove is formed in an outer circumferential face of the rotor 120, and a drive belt 125 is engaged with the circular groove. Further, the drive belt 125 is engaged with a pulley 127, which is driven by a driving section (e.g., electric motor) 126. As shown in FIG. 11, the pulley 127 is fixed to a tubular member 131, which is fixed to a rotary shaft 129 of the motor 126 by a screw 130, by screws 132.

A through-hole 134 is formed in the concave section 115 surrounding the cylindrical section 114 of the cleaning tank 112. The through-hole 134 is communicated with a ring-shaped storing section 136, which is formed in the base 116 to which the motor 126 is fixed and which surrounds the tubular member 131. The cleaning liquid which has cleaned the wafer 16 and flowed into the concave section 115 from the rotor 120, flows into the storing section 136 via the through-hole 134 (see an arrow shown in FIG. 12), then the cleaning liquid is discharged to the exterior via a pipe (not shown).

In FIG. 10, the stopper 26 is moved to a position indicated by solid lines while cleaning the wafer 16 so as to press the wafer 16 mounted on the mount section 123 at a prescribed position and prohibit uplift of the wafer, which is caused by the pressure of the cleaning liquid.

The wafer cleaning and drying unit 25 of the present embodiment has the above described structure.

Next, actions of the cleaning and drying unit 25 will be explained.

The wafer 16 to be cleaned, whose surface has been polished by the polishing unit, is conveyed to the mount section 123. Conveying the wafer 16 is automatically performed by the steps of: sucking and holding the wafer 16 by the polishing head 30; moving the polishing head 30 to a position above the mount section 123; and releasing the wafer 16 there.

Next, the stopper 26 is moved to a position above the wafer 16 by driving a motor 141.

Then, the cleaning liquid, e.g., pure water, whose flow volume and flow speed are sufficient to clean the wafer 16, is pumped into the tubular part 113 of the cleaning tank 112 by actuating a pump (not shown). In the tubular part 113, the cleaning liquid moves upward and collides with a lower surface of the wafer 16, so that the lower surface of the wafer 16 can be cleaned. Further, the cleaning liquid lifts the wafer 16, by the liquid pressure, and flows to the upper side of the wafer 16 via a gap formed between the wafer 16 and the mount section 123, so that the both surfaces of the wafer 16 can be cleaned. The wafer 16 is lifted upward by the liquid pressure of the cleaning liquid, but the stopper 26 presses the wafer 16 so as to prevent the wafer 16 from being pushed out by the pressure.

The used cleaning liquid flows into the storing section 136 via the concave section 115 and the through-hole 134, and then discharged to the exterior.

After cleaning the wafer 16 for a prescribe time, the pump is stopped to complete the cleaning action.

By stopping the pump, a liquid surface of the cleaning liquid in the cleaning tank 112 moves downward until reaching the upper edge of the cylindrical section 114.

Next, the pump is actuated again so as to supply the cleaning liquid to the cleaning tank 112. In this action, a power of the pump is made lower than that for cleaning the wafer 16, so as to make the cleaning liquid override the upper edge of the cylindrical section 114, without reaching the lower surface of the wafer 16, and flow into the gap between the inner wall face of the lower part of the rotor 120 and the outer wall face of the cylindrical section 114, so that the cleaning liquid whose volume is sufficient to form the liquid bearing can be supplied.

The supply volume of the cleaning liquid and the power of the pump are previously determined in a preparatory stage.

In the above described state, the motor 126 is driven to rotate the rotor 120 and the wafer 16 at a high rotational speed, so that the cleaning liquid attached on the surfaces of the wafer 16 can be removed and the wafer 16 can be dried.

When the rotor 120 is rotated at the high speed, the cleaning liquid has flowed into the gap between the inner wall face of the lower part of the rotor 120 and the outer wall face of the cylindrical section 114 to form the liquid bearing, so that the rotor 120 can be rotated smoothly. Particles, which are somewhat formed in the liquid bearing, are flowed into the storing section 136 and discharged to the exterior together with the cleaning liquid passing through the liquid bearing. Therefore, contaminating the wafer 16 with the particles can be prevented.

In the present embodiment, the cleaning action and the drying action can be continuously performed at the same mount section, so that a tact time of the cleaning and drying actions can be shortened.

Successively, the polishing head 30 and the arm unit 31 will be explained with reference to FIGS. 13, 14 and 15.

Figure 13:
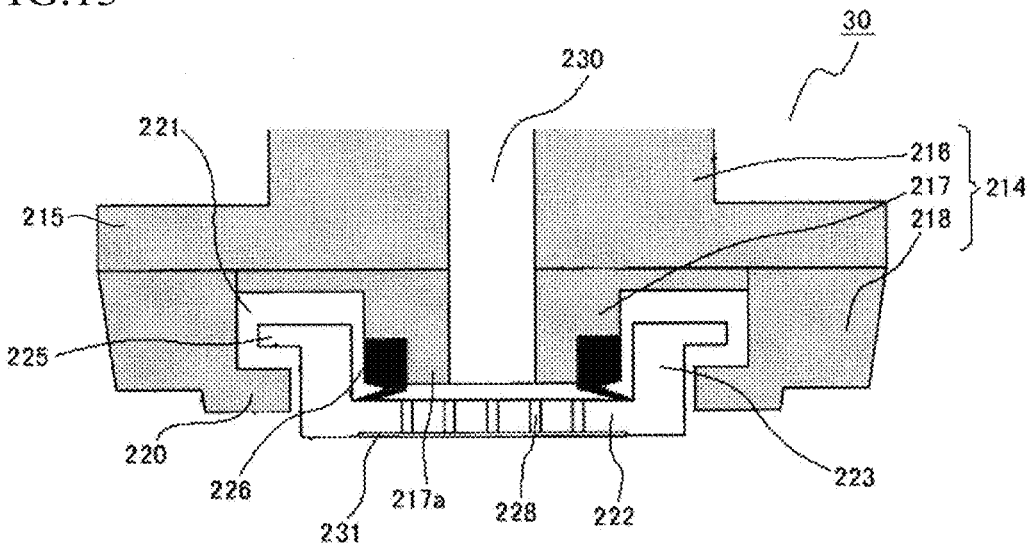
FIG. 13 is a partial sectional view of a polishing head.
Figure 14:
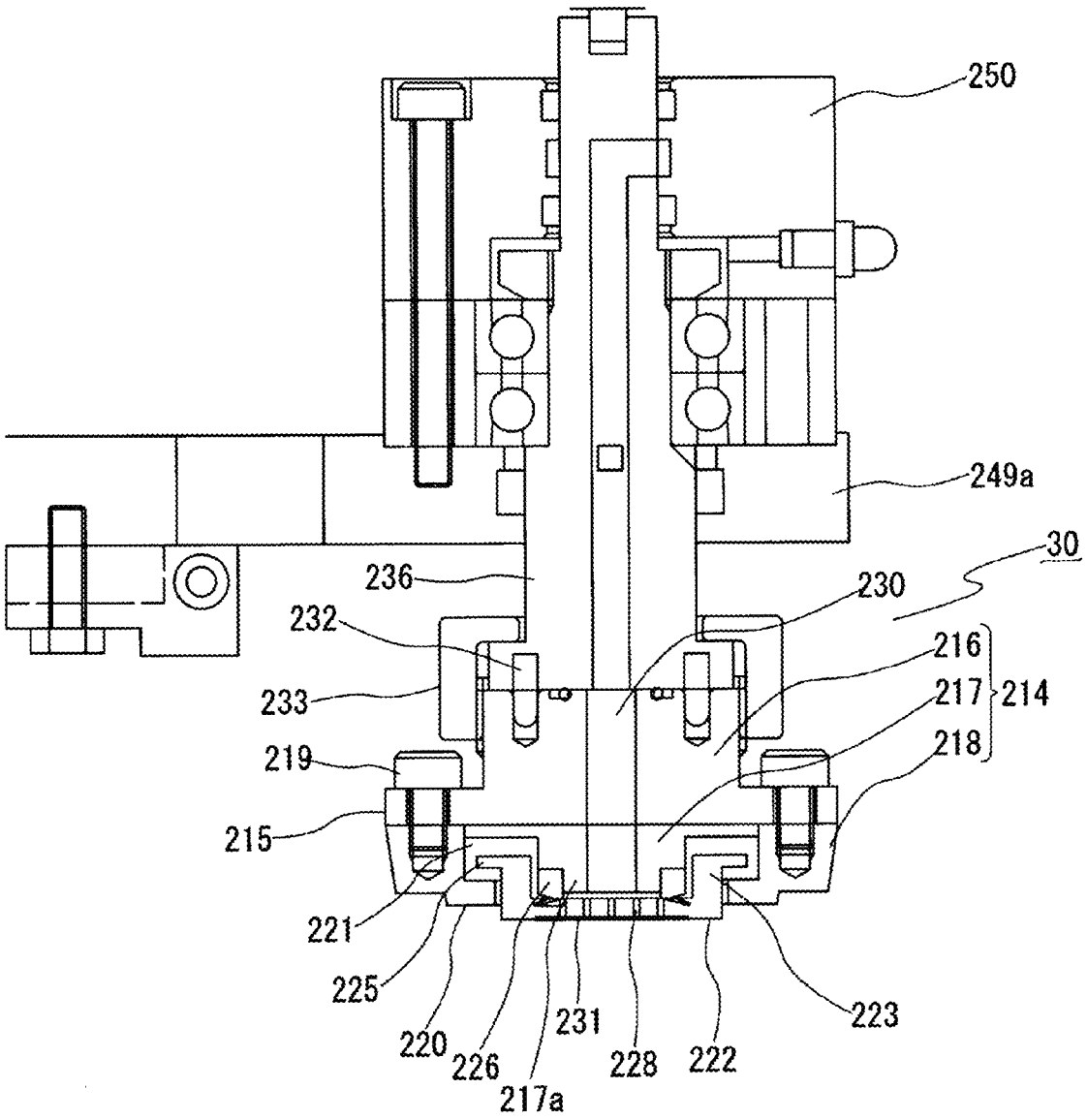
FIG. 14 is a sectional view of the polishing head.
Figure 15:
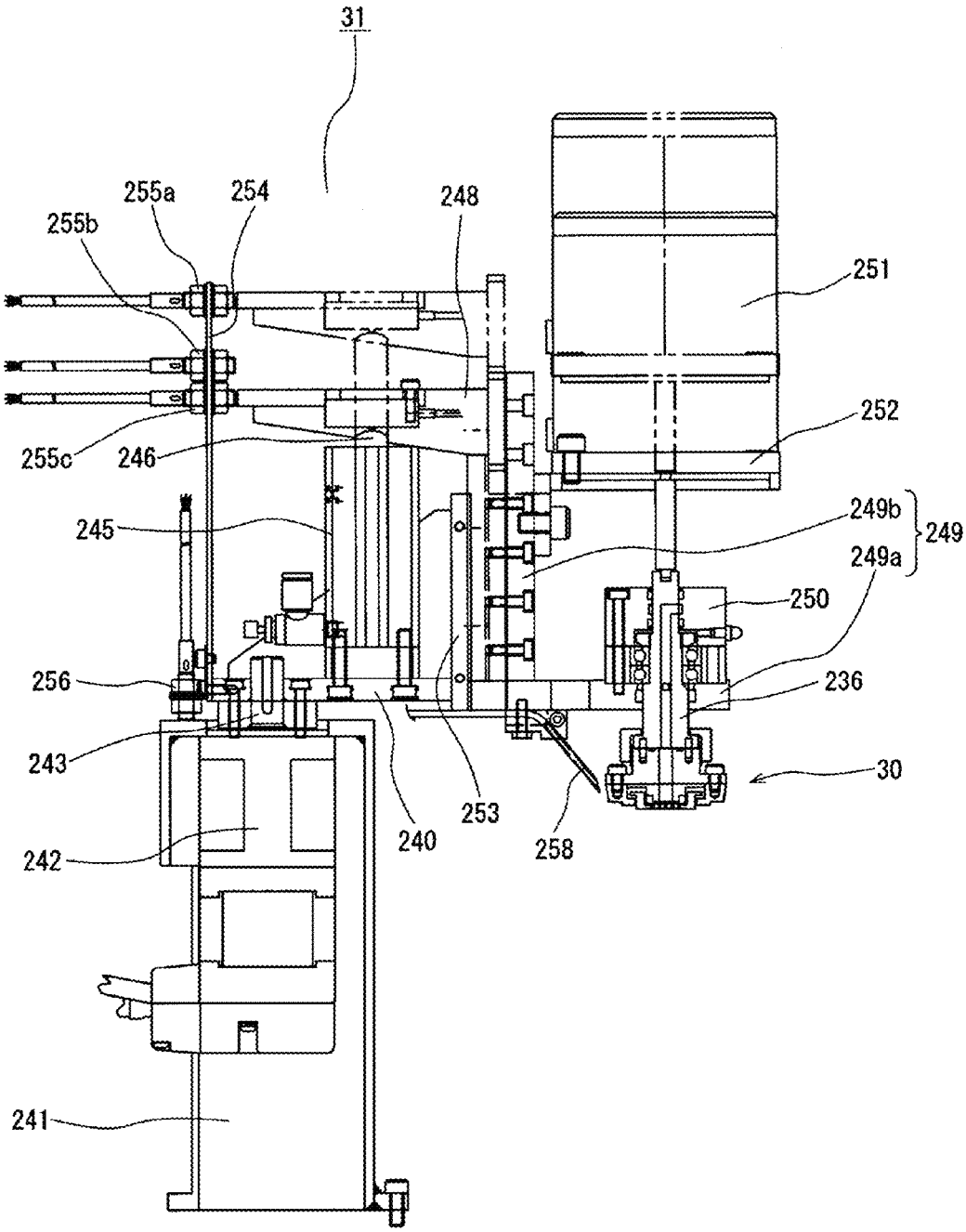
FIG. 15 is a front view of the arm unit.
Figure 16:
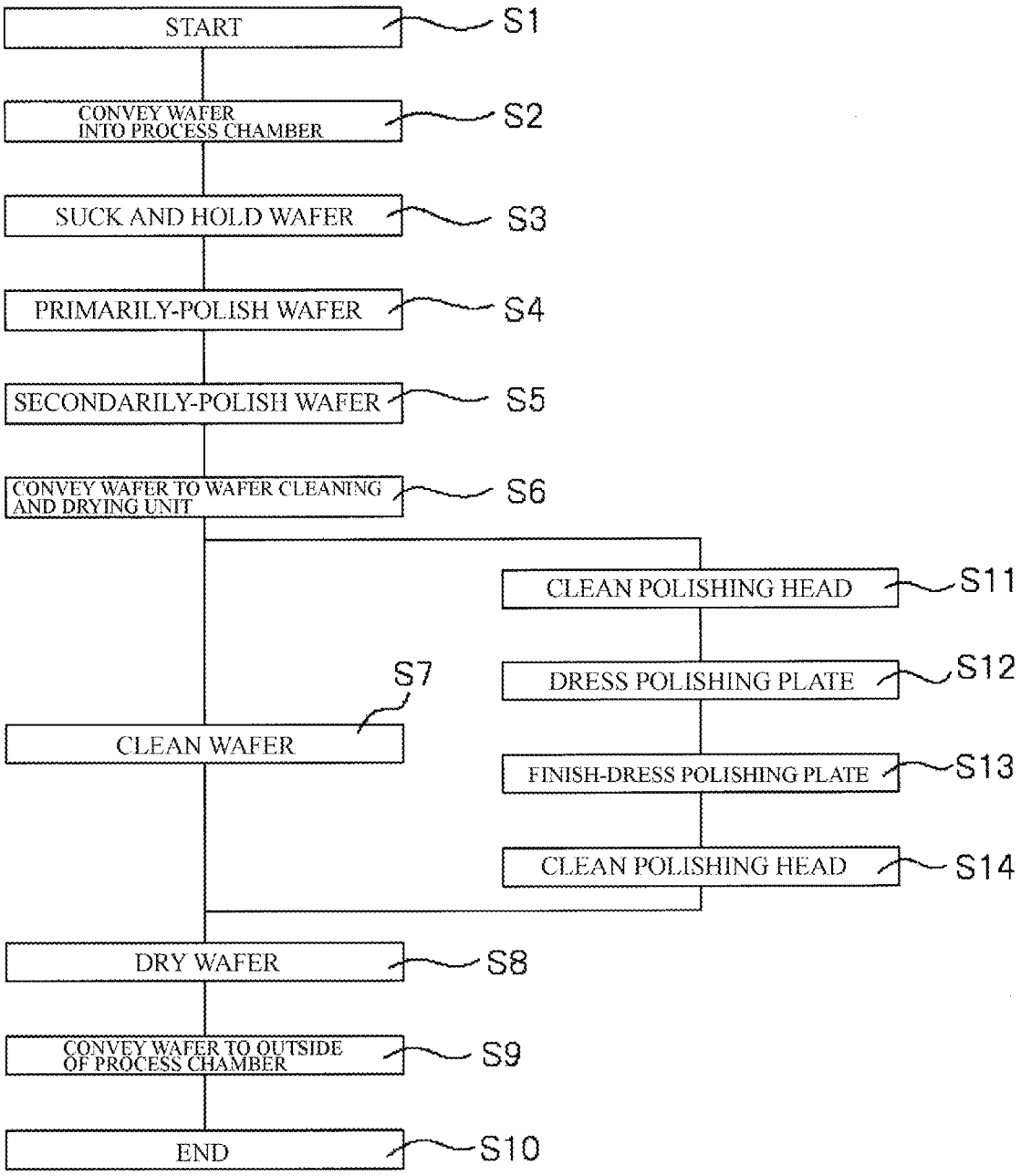
FIG. 16 is a flow chart showing the steps for polishing a wafer.

FIG. 13 is a partial sectional view of the polishing head 30, FIG. 14 is a sectional view of the polishing head 30, and FIG. 15 is a front view of the arm unit 31.

In FIGS. 13 and 14, the polishing head 30 has a main part 214.

The main part 214 comprises: an attachment block 216 having a lower part which includes a flange 215; a press member 217 being fixed on a lower face of the attachment block 216 by screws (not shown); and a ring-shaped engaging member 218, which surrounds the press member 217 and which is fixed on the lower face of the attachment block 216 by bolts 219. Note that, the attachment block 216 and the press member 217 may be integrally formed.

An inner flange 220, which is inwardly projected, is formed in a lower part of the engaging member 218. The inner flange 220 acts as an engaging section. A concave section 221 is formed between an upper face of the inner flange 220 and a lower face of the press member 217 or the lower face of the attachment block 216.

The press member 217 has a columnar press section **217*a*, whose outer diameter is smaller than an inner diameter of the inner flange 220. A height of the press section 217*a* is designed to make a lower part of the press section 217*a* slightly enter the inner flange 220**.

A wafer holding plate 222 is formed like a shallow saucer having a side wall 223.

The side wall 223 of the wafer holding plate 222 enters a space formed between an outer wall face of the press section **217*a* and an outer wall face of the inner flange 220. An outer flange 225, which is outwardly projected, is formed on an upper part of the outer wall face of the side wall 223. The outer flange 225 acts as another engaging section. The lower part of the press section 217***a* enters the wafer holding plate 222, and a lower face of the press section 217*a* is located close to an upper face of the wafer holding plate 222.

The wafer holding plate 222 is capable of moving upward and downward between an outer wall face of the press section 217*a* and an inner wall face of the inner flange 220, and tilting with respect to the main part 214. By engaging the inner flange 220 with the outer flange 225, the wafer holding plate 222 is prohibited to downwardly fall out.

An outer circumference of the lower part of the press section 217*a* is circularly cut, and an upper part of an elastic ring 226 is located in the circularly-cut section and fixed therein. A lower part of the elastic ring 226 is downwardly projected from the press section 217*a* and contacts the upper face of the wafer holding plate 222.

In the present embodiment, the elastic ring 226 has a V-shaped section, and the elastic ring 226 is fixed to the press section 217*a* in a state where an open part of the V-shape is located outward. One of lip sections forming the V-shape contacts the upper face of the wafer holding plate 222.

A plurality of through-holes 228 are formed in a part of the wafer holding plate 222, which is surrounded by the elastic ring 226. A sucking path 230 for sucking air from a space surrounded by the elastic ring 226 is formed in the main part 214. The sucking path 230 is communicated with a vacuum generating unit (not shown). By producing negative pressure by sucking air from the sucking path 230, the wafer 16 can be sucked and held on the lower face of the wafer holding plate 222. In this case, the elastic ring 226 acts as a seal ring, too.

A concave section 231 for accommodating the wafer 16 is formed in the lower face of the wafer holding plate 222. By accommodating the wafer 16 in the concave section 231, the wafer 16 can be prevented from jumping out while polishing the wafer 16.

Note that, the wafer 16 need not be sucked. For example, the wafer 16 may be held by adhering a backing member (not shown) adhered on the lower face of the wafer holding plate 222 and soaking the backing member with water so as to hold the wafer 16 on the lower face of the backing member by surface tension of the water.

The elastic ring 226 need not have the V-shaped section. For example, a mere O-ring may be employed.

Anyway, the elastic ring 226 has enough elastic force to receive the wafer holding plate 222 and allow the wafer holding plate 222 to tilt with following the surface of the polishing cloth of the polishing plate 18 when the wafer 16 is pressed onto the polishing cloth of the polishing plate 18, with the elastic ring 226 and the wafer holding plate 222, by the press section 217*a* of the main part 214.

The elastic ring 226 acts as a tilting center of the wafer holding plate 222. The elastic ring 226 is directly provided between the lower face of the press section 217*a* and the upper face of the wafer holding plate 222 and compressed by the pressing force of the press section 217*a*, so that the tilting center of the wafer holding plate 222 can be located close to the polishing cloth of the polishing plate 18 and can be lowered.

The polishing head 30 is detachably attached to a rotary shaft 236 on the arm unit 31 side by screwing a screw ring 233 with a male screw section formed on an outer circumferential face of the attachment block 216, and the polishing head 30 is turned, with the rotary shaft 236, about axial line of the rotary shaft 236. Positioning pins 232 are provided. Note that, a torque of the press section 217*a* side is transmitted to the wafer holding plate 222 by a frictional force generated between the wafer holding plate 222 and the elastic ring 226 pressed onto the upper face of the wafer holding plate 222.

The wafer holding plate 222 is rotated by the frictional force generated between the wafer holding plate 222 and the elastic ring 226. Therefore, even if a large torque is generated on the wafer holding plate 222 side, the press section 217*a* side idly rotates and no excessive force is applied to the wafer 16, so this structure is suitable for polishing thin wafers.

Note that, in some cases, the torque of the press section 217*a* side may be directly transmitted to the wafer holding plate 222 side by transmitting pins (not shown).

Successively, the arm unit 31 will be explained with reference to FIG. 15.

A rotary arm 240 is fixed to a rotary shaft 243 of a motor 242, which is capable of rotating in a normal direction and a reverse direction and which is fixed on a base 241. Therefore, the rotary arm 240 is capable of reciprocally turned, in a horizontal plane, between prescribed positions.

A cylinder unit 245 is provided on the rotary arm 240, and a stay 248 is fixed to a rod 246 of the cylinder unit 245. An L-shaped attachment arm 249 is fixed to the stay 248 (see FIG. 15).

The rotary shaft 236, to which the polishing head 30 will be attached, is attached to a horizontal plate 249*a* of the attachment arm 249 with a bearing 250. A motor 251 for rotating the rotary shaft 236 is fixed on an attachment plate 252, which is located above the horizontal plate 249*a* and horizontally fixed to a vertical plate 249*b* of the attachment arm 249. A guide plate 253 guides the vertical plate 249*b* of the attachment arm 249.

By actuating the cylinder unit 245 to move the rod 246 upward and downward, the polishing head 30 and the motor 251 are moved upward and downward with the stay 248 and the attachment arm 249. Further, the polishing head 30 and the motor 251 are turned in a horizontal plane by turning the rotary arm 240.

Sensors 255*a*, 255*b* and 255*c* are vertically arranged, with separations, on an attachment rod 254, which is erected from the rotary arm 240. Each of the sensors 255*a*, 255*b* and 255*c* detects the position of the stay 248. The sensor 255*a* detects that the polishing head 30 is upwardly moved to a prescribed position, and the upward movement of the polishing head 30 is stopped there. The sensor 255*c* detects that the polishing head 30 is downwardly moved to a prescribed lower limit position where the polishing head 30 sucks and holds the wafer 16 mounted on the mount section 123 of the wafer cleaning and drying unit 25 before polishing or that the wafer 16 is downwardly moved to a lower limit position where the wafer 16 held by the polishing head 30 contacts the polishing cloth of the polishing plate 18, and the downward movement of the polishing head 30 is stopped there.

When the polishing head 30 is moved downward, the polishing head 30 is moved downward at a high speed until the sensor 255*b* detects, then the polishing head 30 is moved downward at a low speed until the sensor 255*c* detects. With these actions, a tact time can be shortened and colliding the wafer 16 with the mount section 123 and the polishing cloth of the polishing plate 18 can be prevented.

A sensor 256 is provided to a rear end of the rotary arm 240, which detects a mark (not shown) located on a moving track of the sensor 256 moved with the rotary arm 240, so as to stop the rotary arm 240 at a prescribed position.

Note that, a hose 258 sprays the cleaning liquid toward the polishing head 30 when the polishing head 30 is cleaned by a brush.

The polishing head 30 and the arm unit 31 have the above described structures.

Next, the polishing actions for polishing the wafer 16 will be explained.

Firstly, the motor 242 is driven so as to turn the rotary arm 240 until reaching the prescribed position, which is above the mount section 123 on which the wafer 16 to be polished has been mounted, and then, at the same position, the cylinder unit 245 is actuated so as to move the polishing head 30 downward until contacting the wafer 16. Further, the vacuum generation unit (not shown) is driven so as to suck and hold the wafer 16 on the lower face of the wafer holding plate 222.

Next, the polishing head 30 is moved upward, and the rotary arm 240 and the polishing head 30 are turned until the polishing head 30 reaches the position above the polishing plate 18.

Next, the polishing head 30 is moved downward so as to bring the wafer 16, which has been held on the lower face of the wafer holding plate 222 of the polishing head 30, into contact with the polishing cloth of the polishing plate 18.

Then, the wafer 16 is polished by rotating the polishing plate 18, driving the motor 251 to turn the polishing head 30 and supplying the slurries onto the polishing plate 18 from a nozzle (not shown).

After completing the polishing action, the polishing head 30 is moved upward, the rotary arm 240 is turned and the polishing head 30 is moved downward so as to convey the polished wafer 16 to a predetermined place (i.e., the mount section 123 of the wafer cleaning and drying unit 25). Note that, the slurry for the primary polishing, the slurry for the secondary polishing and the cleaning liquid for cleaning the polishing head may be selectively supplied through the hose 258.

The force pressing the wafer 16 onto the polishing cloth is a weight of the polishing head 30 side (including a weight of the motor 251 and a weight of the attachment arm 249 side) minus a lifting force of the cylinder unit 245 side. By adjusting the pressing force, polishing the wafer 16 is performed with applying a constant polishing pressure.

As described above, in case of polishing the wafer under the Minimalfab Concept, the small wafer 16, whose diameter is about 0.5 inch, is polished. In the present embodiment, the tilting center of the wafer holding plate 222, with respect to the polishing cloth, corresponds to the position of the elastic ring 226, which is provided between the upper face of the wafer holding plate 222 and the lower face of the press section 217*a*, so the tilting center can be located close to the polishing cloth and lowered. Therefore, even if the wafer 16 is said small wafer, the wafer 16 can be suitably polished without being engaged with the polishing cloth.

Details of each of the units of the wafer polishing apparatus have been described above.

Successively, a sequence of polishing the wafer 16 in the wafer polishing apparatus 10 will be explained.

Note that, the sequence is controlled, by a control section (not shown), on the basis of a predetermined program.

Firstly, the wafer 16 is mounted onto the mount section 15 of the conveying arm 14 in a state where the surface to be polished is faced upward.

Next, a start switch (not shown) is turned on (step S1). Upon turning the start switch, the sequence of the polishing process is automatically started on the basis of the predetermined program.

Namely, the wafer 16 is conveyed into the process chamber 12, from the outside, by the conveying arm 14 (step S2).

Next, as described above, the transfer arm 20 receives the wafer 16 from the conveying arm 14, inverts the wafer 16 and mounts the wafer 16 onto the mount section 123 of the wafer cleaning and drying unit 25 in the state where the surface to be polished is faced downward.

Then, the rotary arm 240 is turned and the polishing head 30 is moved downward so as to suck and hold the wafer 16 by the wafer holding plate 222 (step S3).

Further, the polishing head 30 is moved upward, the rotary arm 240 is turned, and then the polishing head 30 is moved downward so as to press the wafer 16 onto the polishing cloth 40*a* with the prescribed pressing pressure. The polishing plate 18 and the polishing heads 30 are rotated in prescribed directions with supplying the slurry, from the nozzle (not shown), to the primary polishing part 40, so as to primarily-polish (roughly-polish) the wafer 16 for a prescribed time (step S4). Most of the slurry for the primary polishing is flowed outward from the primary polishing part 40 by the centrifugal force of the rotating polishing plate 18, and discharged to the exterior via the discharge hole 57.

After completing the primary polishing, the polishing head 30 is moved upward, the rotary arm 240 is turned, then the polishing head 30 is moved downward so as to bring the wafer 16 into contact with the polishing cloth 41*a* of the secondary polishing part 41. And, the polishing plate 18 and the polishing heads 30 are rotated in prescribed directions with supplying the slurry, from the nozzle (not shown), to the polishing cloth 41*a* of the secondary polishing part 41, so as to secondarily-polish (finish-polish) the wafer 16 for a prescribed time, as well as the primary polishing (step S5). The slurry for the secondary polishing is flowed into the groove 42, from the polishing cloth 41*a* of the secondary polishing part 41, by the centrifugal force of the rotating polishing plate 18, discharged to outside of the polishing plate 18 via the through-hole 56, and then discharged to the exterior via the discharge hole 57. Therefore, the slurry for the primary polishing and the slurry for the secondary polishing are not mixed on the polishing cloths 40*a* and 41*a*.

After completing the secondary polishing, the polishing head 30 is moved upward, the rotary arm 240 is turned, then the polishing head 30 is moved downward so as to mount the polished wafer 16 onto the mount section 123 of the wafer cleaning and drying unit 25 (step S6).

In the wafer cleaning and drying unit 25, the wafer 16 is cleaned (step S7) and dried (step S8) as described above. When the wafer 16 is cleaned and dried, the stopper 26 is turned until reaching the position above the wafer 16 so as to hold the wafer 16 on the mount section 123. After completing the cleaning and drying the wafer 16, the stopper 26 is turned until reaching the standby position, which is located beside the polishing plate 18.

The wafer 16 which has cleaned and dried is transferred onto the conveying arm 14, from the mount section 123, by the transfer arm 20, and then the wafer 16 is conveyed to outside of the process chamber 12 by the conveying arm 14 (step S9). By performing the above described steps, the polishing process is completed (step S10).

Note that, while cleaning the wafer in the wafer cleaning and drying unit 25, the polishing head 30 is cleaned. Namely, the polishing head 30 is moved upward, the rotary arm 240 is turned, then the polishing head 30 is moved downward so as to bring the polishing head 30 into contact with the brush 44*a* of the head cleaning section 44. Further, the head cleaning section 44 is turned and cleaning water is sprayed, from the hose 258, toward the polishing head 30, so that the polishing head 30 can be cleaned (step S11). The cleaning water is discharge to the exterior via the groove 45, the through-hole 55, the groove 42 and the through-hole 56.

After cleaning the polishing head 30, dressing the polishing plate 18 is performed. Namely, the polishing head 30 sucks and picks up the ring-shaped grind stone from the mount section 34, and conveys the grind stone onto the polishing plate 18. Then, the polishing plate 18 is rotated so as to dress the polishing cloths of the primary polishing part 40 and the secondary polishing part 41 (step S12). After dressing the polishing cloths, the grind stone is returned to the mount section 34.

Further, the polishing head 30 sucks and picks up the brush from the mount section 35, and conveys the brush onto the polishing plate 18. the polishing plate 18 is rotated so as to finish-dress the polishing cloths of the primary polishing part 40 and the secondary polishing part 41 (step S13). After completing the finish-dressing action, the brush is returned to the mount section 35.

After completing the finish-dressing action, the polishing head 30 is moved to the cleaning section 44 again so as to clean the polishing head 30 (step S14). After cleaning the polishing head 30, the polishing head 30 is returned to the standby position (i.e., the position Pos01). By returning to the standby position, the sequence of polishing the wafer polishing is completed.

As described above, cleaning the polishing head 30 and dressing the primary and secondary polishing parts 40 and 41 can be performed while cleaning and drying the wafer 16, so that the polishing steps can be efficiently performed.

Note that, dressing the polishing plate 18 may be performed every time after the wafer 16 is polished or every time after a prescribed number of the wafers 16 are polished.

Figure 17:
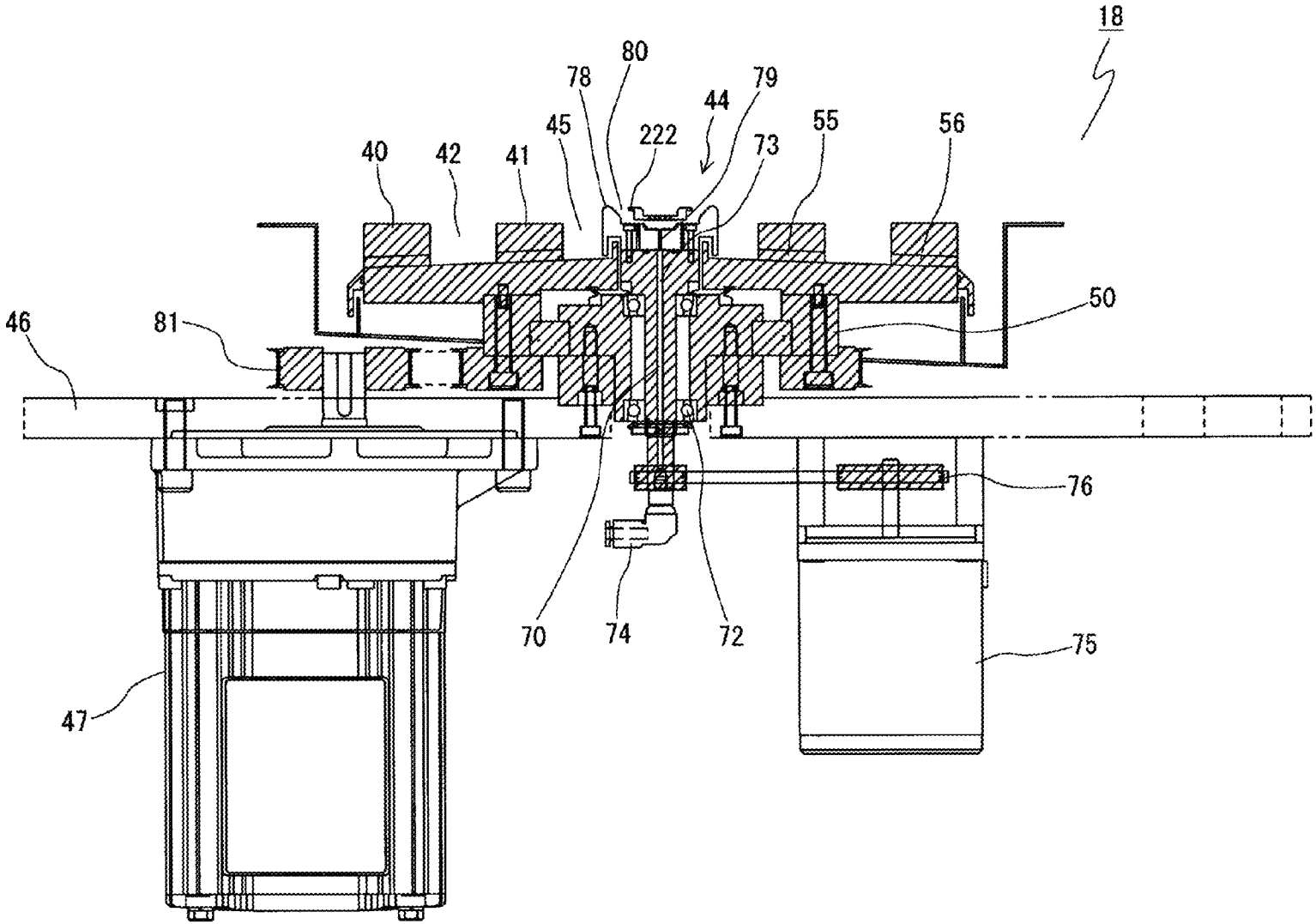
FIG. 17 is a sectional view of a further example of the polishing plate.

FIG. 17 is a sectional view of the polishing plate 18 of a further example.

The structural elements shown in FIG. 7 are assigned the same reference symbols, and explanation will be omitted.

In the present example, the wafer cleaning and drying unit 25 acts as the cleaning section 44 located at the center part of the polishing plate 18. Other structural elements are the same as those of the polishing plate 18 shown in FIG. 7.

A rotary nozzle 70 is rotatably held in a through-hole, which is formed in the center of the polishing plate 18 and the center of the plate holding section 50, by a bearing 72. A nozzle hole 73 is formed in a center part of the rotary nozzle 70.

The cleaning liquid is supplied to the nozzle hole 73 via a hose (not shown) connected to a joint 74. The rotary nozzle 70 is turned by a drive belt 76, which is driven by a motor 75 fixed on the base 46.

A wafer mount plate 78 is fixed to an upper end of the rotary nozzle 70. A nozzle hole 79, which is communicated with the nozzle hole 73, is opened in the wafer mount plate 78. Further, a concave section 80 for holding the wafer 16 is formed in an upper face of the wafer mount plate 78. Note that, a stopper (not shown), which is capable of turning between a position above the concave section 80 and a position beside the polishing plate 18, is provided.

The polishing plate 18 is rotated by a drive belt 81 and the motor 47.

In the present example, after polishing the wafer 16 with the secondary polishing part 41, the polishing head 30 conveys the polished wafer 16 onto the wafer mount plate 78, the rotary nozzle 70 is turned and sprays the cleaning liquid, from the nozzle hole 79, toward the lower face of the wafer 16, with pressing the wafer 16 at a prescribed position, by the stopper, so as to prevent uplift of the wafer 16, so that the wafer 16 can be cleaned. After completing the cleaning step, supplying the cleaning liquid is stopped, and the rotary nozzle 70 is rotated at a high speed so as to dry the wafer 16.

The polishing head 30 takes the cleaned and dried wafer 16 and transfers the same to the conveying arm 14 by the transfer arm 20, then the wafer 16 is conveyed to outside of the process chamber 12.

In the present example, after completing the secondary polishing step, the wafer 16 can be cleaned by the wafer cleaning and drying unit 25 which is closely located, so that the wafer 16 can be well cleaned.

Note that, the polishing head 30 is cleaned by the head cleaning section which is located beside the polishing plate 18.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention has been described in detail, it should be understood that the various changes, substitutions, and alternations could be made hereto without departing from the spirit and scope of the invention.

What is claimed is:

1. A wafer polishing apparatus, comprising: a polishing plate having an upper face, on which a polishing cloth is adhered; a polishing head having an lower face for holding a wafer; and a slurry supplying section for supplying slurry to the upper face of the polishing plate, wherein the wafer held by the polishing head is pressed onto the polishing cloth, the polishing plate and the polishing head are relatively moved with respect to each other, with supplying slurry, so as to polish the wafer, wherein the polishing plate includes:

a plurality of concentric polishing zones, each of which has a prescribed width for polishing the wafer and on each of which a polishing cloth is adhered; and a groove for discharging slurry being formed between the polishing zones, and wherein a head cleaning section, which cleans the polishing head, or a wafer cleaning section, which cleans the polished wafer, is provided to a center part of the polishing plate and located on the inner side of the innermost polishing zone.

2. The wafer polishing apparatus according to claim 1, wherein the polishing head is capable of moving between the polishing zones and polishing the wafer in each of the polishing zones.

3. The wafer polishing apparatus according to claim 1, wherein the polishing zones are detachably attached to a plate holding section, to which the polishing plate is attached.

4. The wafer polishing apparatus according to claim 3, wherein the polishing zones are capable of being separately detached from the plate holding section.

5. The wafer polishing apparatus according to claim 3, wherein the polishing zones are detachably positioned, on the plate holding section, by positioning pins.

6. The wafer polishing apparatus according to claim 1, wherein heights of the polishing faces of the polishing zones are different from each other.

7. The wafer polishing apparatus according to claim 6, wherein the height of the polishing face of the outer polishing zone is higher than that of the inner polishing zone.

8. The wafer polishing apparatus according to claim 1, wherein the polishing zones respectively have through-holes, in each of which a height is reduced outward so as to discharge the slurry in the groove to outside of the polishing plate.

9. The wafer polishing apparatus according to claim 1, wherein the wafer cleaning section is provided to the center part of the polishing plate, the head cleaning section is provided to a periphery of the polishing plate, and the polishing head conveys the wafer to the wafer cleaning section.

10. The wafer polishing apparatus according to claim 1, wherein the head cleaning section is provided to the center part of the polishing plate, the wafer cleaning section is provided to a periphery of the polishing plate, and the polishing head conveys the wafer to the wafer cleaning section.

11. The wafer polishing apparatus according to claim 10, wherein a dressing member mount section is provided to a periphery of the polishing plate, and the polishing head conveys a dressing member, which has been mounted on the dressing member mount section, to the polishing zone and dresses the polishing cloth of the polishing zone.

12. The wafer polishing apparatus according to claim 11, wherein the dressing member mount section, the wafer cleaning section, the polishing zones and the head cleaning section are located on a circular arc or a linear line.

13. The wafer polishing apparatus according to claim 12, wherein the polishing head is provided to an arm unit, a control section controls actions of the arm unit, and the control section controls the polishing head to move between the dressing member mount section, the wafer cleaning section, the polishing zones and the head cleaning section, which are located on the circular arc or the linear line, so as to polish the wafer, clean the polished wafer, clean the polishing head and dress the polishing cloths of the polishing zones with the dressing member.

14. The wafer polishing apparatus according to claim 1, wherein the slurry discharged outside of the polishing plate and a used cleaning liquid are separately collected.

15. The wafer polishing apparatus according to claim 1, wherein the polishing head comprises:

a main part having a lower face, to which a press section is provided;

a wafer holding plate being held on the lower face of the main part and capable of tilting with respect to the main part, the wafer holding plate having a lower face, on which the wafer to be polished can be held; and an elastic ring being attached to the press section of the main part, the elastic ring pressing an upper face of the wafer holding plate, and wherein the wafer holding plate, which receives an elastic force of the elastic ring, is capable of tilting along with a surface of the polishing cloth of the polishing plate when the wafer is pressed onto the polishing cloth of the polishing plate, together with the elastic ring and the wafer holding plate, by the press section on the main part.

16. The wafer polishing apparatus according to claim 15, wherein the elastic ring has a V-shaped section, and the elastic ring is provided between the press section of the main part and the upper face of the wafer holding plate in a state where an open part of the V-shape is faced outward.

17. The wafer polishing apparatus according to claim 15, wherein a plurality of through-holes are formed in a part of the wafer holding plate which is surrounded with the elastic ring, a sucking path for sucking a gas from a space surrounded by the elastic ring is formed in the press section of the main part, and the elastic ring acts as a seal ring.

18. The wafer polishing apparatus according to claim 15, wherein the lower face of the main part is opened to form a concave section, and the tiltable wafer holding plate is held in the concave section.

19. The wafer polishing apparatus according to claim 18, wherein an engage section is inwardly projected from an inner wall face of the concave section, another engage section is outwardly projected from an outer wall face of the wafer holding plate, and the wafer holding plate is retained in the concave section by engagement of the both engage sections.

20. The wafer polishing apparatus according to claim 19, wherein the wafer holding plate is formed like a saucer having a circular side wall, the engaging section is formed on the outer wall face of the circular side wall, and a lower part of the press section of the main part enters a space surrounded by the circular side wall of the wafer holding plate.

21. The wafer polishing apparatus according to claim 15, wherein the wafer holding plate is not connected with the elastic ring which presses the upper face of the wafer holding plate, but a torque from the press section side is transmitted by a frictional force generated therebetween.

22. The wafer polishing apparatus according to claim 10, wherein the wafer cleaning section comprises:

a cleaning tank, into which the cleaning liquid is introduced, having an upper part, which is formed as a cylindrical section;

a rotor, which is formed into a cylindrical shape, having a lower part, which is fitted with the cylindrical section of the cleaning tank and capable of rotating about an axial line of the cylindrical section, and an upper face, which includes an opening section whose edge acts as a mount section on which the wafer to be cleaned and dried can be mounted;

a drive section for rotating the rotor; and a bearing being formed between the lower part of the rotor and the cylindrical section of the cleaning tank.

23. The wafer polishing apparatus according to claim 22, further comprising a stopper being capable of moving between a position above the mount section of the rotor and a position beside the rotor, the stopper stopping uplift of the wafer mounted on the mount section, which is caused by a pressure of the cleaning liquid, at a prescribed position.

24. The wafer polishing apparatus according to claim 22, wherein the bearing has a structure of a liquid bearing.

25. The wafer polishing apparatus according to claim 24, wherein the liquid bearing is formed by introducing a part of the cleaning liquid, from an upper edge of the cylindrical section of the cleaning tank, to a space between the lower part of the rotor and the cylindrical section.

26. The wafer polishing apparatus according to claim 24, wherein a groove for flowing a part of the cleaning liquid is formed in at least one of an inner wall face of the lower part of the rotor and an outer wall face of the cylindrical section of the cleaning tank.

27. The wafer polishing apparatus according to claim 22, wherein a flow path, through which a part of the cleaning liquid can be flowed, is formed between the lower part of the rotor and an outer wall face of the cylindrical section of the cleaning tank, and a roller bearing, which acts as the bearing, is provided in the flow path.

28. The wafer polishing apparatus according to claim 22, wherein an ultrasonic oscillator is provided in the cleaning tank.

29. The wafer polishing apparatus according to claim 22, wherein the drive section comprises a drive belt being engaged with the rotor and a pulley.

* * * * *